US007452649B2

(12) United States Patent
Magome et al.

(10) Patent No.: US 7,452,649 B2
(45) Date of Patent: Nov. 18, 2008

(54) MAGNETIC TONER, AND IMAGE FORMING METHOD

(75) Inventors: Michihisa Magome, Shizuoka (JP); Eriko Yanase, Shizuoka (JP); Atsushi Tani, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 275 days.

(21) Appl. No.: 10/936,561

(22) Filed: Sep. 9, 2004

(65) Prior Publication Data

US 2005/0058922 A1 Mar. 17, 2005

(30) Foreign Application Priority Data

Sep. 12, 2003 (JP) ..... 2003-321147

(51) Int. Cl.
*G03G 9/083* (2006.01)

(52) U.S. Cl. ..... 430/111.3; 430/137.13

(58) Field of Classification Search ..... 430/111.3, 430/137.13
See application file for complete search history.

(56) References Cited

U.S. PATENT DOCUMENTS

| | | | | |
|---|---|---|---|---|
| 5,111,998 | A | 5/1992 | Kanda et al. | 241/5 |
| 5,750,302 | A | 5/1998 | Ogawa et al. | 430/106.6 |
| 6,077,638 | A | 6/2000 | Tanikawa et al. | 430/106 |
| 6,183,927 | B1 | 2/2001 | Magome et al. | 430/110 |
| 6,270,937 | B2 | 8/2001 | Yuasa et al. | 430/109 |
| 6,447,969 | B1 | 9/2002 | Ito et al. | 430/106.2 |
| 6,465,144 | B1 | 10/2002 | Hashimoto et al. | 430/106.1 |
| 6,596,452 | B2 | 7/2003 | Magome et al. | 430/106.2 |
| 6,638,674 | B2 | 10/2003 | Komoto et al. | 430/106.1 |
| 2002/0055052 | A1 | 5/2002 | Komoto et al. | 430/106.1 |
| 2002/0115011 | A1 | 8/2002 | Komoto et al. | 430/125 |

FOREIGN PATENT DOCUMENTS

| | | | |
|---|---|---|---|
| JP | 1-259369 | | 10/1989 |
| JP | 1-259372 | | 10/1989 |
| JP | 04258964 | * | 9/1992 |
| JP | 5-297630 | | 11/1993 |
| JP | 9-319137 | | 12/1997 |
| JP | 409319137 | * | 12/1997 |

OTHER PUBLICATIONS

Abstract of JP 04258964.*
Abstract of JP409319137.*
English language machine translation of JP 409319137.*
Abstract of JP 04158964. Sep. 1992.*
Abstract of JP 409319137. Dec. 1997.*
English langauge machine translation of JP 409319137. Dec. 1997.*

* cited by examiner

*Primary Examiner*—Hoa V Le
(74) *Attorney, Agent, or Firm*—Fitzpatrick, Cella, Harper & Scinto

(57) ABSTRACT

A magnetic toner is provided having at last a binder resin and a magnetic material and having a weight-average particle diameter of 3 μm to 10 μm. The magnetic material has been surface-treated with a low-softening substance (A), and has a compressibility of 35 or more which can be calculated according to a specific expression. The softening point of the magnetic toner is from 40° C. to 85° C. in measurement by a flow tester. The magnetic toner has a resin component containing 1% to 60% by weight of a tetrahydrofuran-insoluble matter. This magnetic toner is superior in low-temperature fixing performance and has good fixing performance in a broad fixing range.

14 Claims, 2 Drawing Sheets

MAGNETIC TONER, AND IMAGE FORMING METHOD

BACKGROUND OF THE INVENTION

1. Field of the Invention

This invention relates to a magnetic toner used in recording processes such as electrophotography, electrostatic recording, electrostatic printing and so forth. This invention also relates to an image forming method making use of the magnetic toner.

2. Related Background Art

A number of methods are conventionally known as methods for electrophotography. In general, copies or prints are obtained by forming an electrostatic latent image on an electrostatic latent image bearing member (hereinafter also "photosensitive member") by utilizing a photoconductive material and by various means, subsequently developing the latent image by the use of a toner to form a toner image as a visible image, transferring the toner image to a recording medium such as paper as occasion calls, and then fixing the toner image to the recording medium by the action of heat and/or pressure. Apparatus for such image forming include copying machines and printers.

In recent years, these printers or copying machines have been advanced from analogue machines to digital machines, and it is strongly required to have faithful reproducibility of latent images and high resolution and at the same time to reduce power consumption in their use.

Here, taking note of printers, for example, the proportion of power consumption in the fixing step is fairly large in respect to the total power consumption, and hence the power consumption may increase with a rise in fixing temperature. High fixing temperature may also cause problems such as curl of image-printed paper after fixing. Accordingly, there is a great desire for lowering fixing temperature. It is further sought to deal with various recording materials, where toners are required to have good fixing performance in a broad temperature range.

To cope with this, until now, many studies have been made on how to fix toners at lower temperature. For example, as disclosed in Japanese Patent Application Laid-open No. H5-297630, it is reported that by controlling molecular weight distribution and THF (tetrahydrofuran)-insoluble matter, low-temperature fixing performance is improved and both low-temperature fixing performance and high-temperature anti-offset properties are achieved.

Many studies are also made on low-softening substances to be added to toners. A technique is proposed in which particle surfaces of a magnetic powder is treated with a low-softening substance to improve the dispersibility of the magnetic powder in toner and also to improve fixing performance (e.g., Japanese Patent Applications Laid-open No. H9-319137, No. H1-259369 and No. H1-259372).

However, even with use of such a magnetic powder, there is still room for improvement in both low-temperature fixing performance and high-temperature anti-offset properties, and the improvement in fixing performance has still been insufficient.

SUMMARY OF THE INVENTION

An object of the present invention is to provide a magnetic toner having superior low-temperature fixing performance and good fixing performance in a broad fixing range.

Another object of the present invention is to provide a magnetic toner which can form highly minute images free of any image defects such as fog and toner melt adhesion.

More specifically, the present invention provides a magnetic toner having at least a binder resin and a magnetic material and having a weight-average particle diameter of from 3 μm to 10 μm, wherein;

the magnetic material is what obtained by treating magnetic fine particles with a low-softening substance (A), and having a compressibility of 35 or more which is found from the following expression (1):

$$\text{compressibility}=(1-(\text{apparent density}/\text{tap density}))\times 100 \quad (1);$$

the magnetic toner has a softening point Ts of from 40° C. to 85° C. in measurement by a flow tester; and the magnetic toner has a resin component having 1% by weight to 60% by weight of a THF(tetrahydrofuran)-insoluble matter.

DESCRIPTION OF PREFERRED EMBODIMENTS

Figure 1:
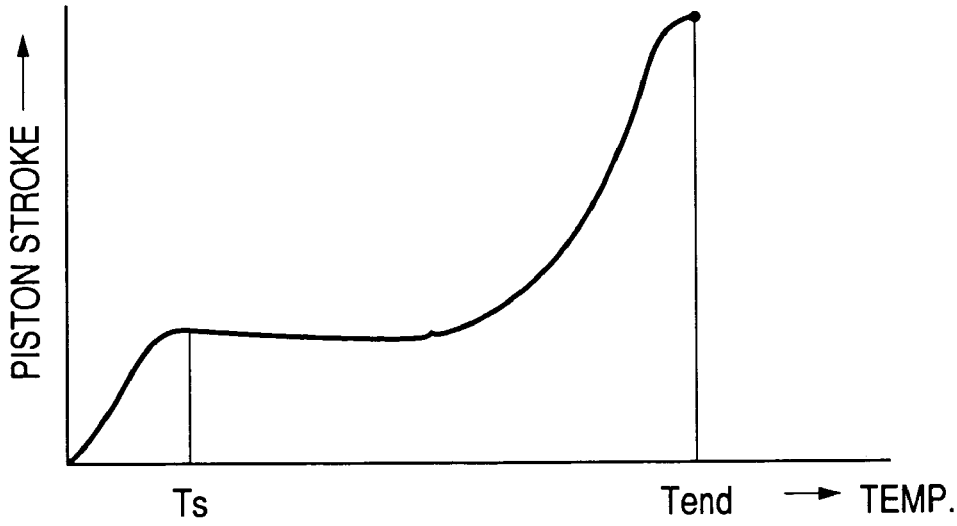
FIG. 1 is a graph showing an example of a flow curve obtained by a flow tester.

As a result of extensive studies made by the present inventors, it has been made possible to vastly improve low-temperature fixing performance and achieve both low-temperature fixing performance and high-temperature anti-offset properties, by using a magnetic material having been surface-treated and allowing a toner to have a specific softening point and THF-insoluble matter. Thus, they have accomplished the present invention.

Considering the behavior of a toner at the time of fixing, it is presumed that in the toner coming into contact with a high-temperature fixing member, the heat travels from the surfaces of toner particles to the interiors thereof, where resin portions are plasticized and deformed and also the low-softening substance contained therein melts and exudes, whereby release from the fixing member is improved and fixing is performed without causing offset.

Here, considering a magnetic toner, the magnetic toner contains in the interiors of its particles a magnetic material in a large quantity. This magnetic material has a higher specific heat than the resin, and hence may inevitably absorb part of the heat the toner receives at the time of fixing, so that the heat coming form the fixing assembly can not readily effectively be used for plasticizing and deforming the resin and for melting the low-softening substance.

The present inventors have considered that the surfaces of magnetic fine particles may previously uniformly be treated with a low-softening substance (A) (a low-softening substance used in the surface treatment of magnetic fine particles is called "low-softening substance (A)") so that the low-softening substance (A) can melt and exude before the magnetic material (in the present invention, one obtained by treating the surfaces of "magnetic fine particles" with a low-softening substance is called "magnetic material") takes away the heat the toner receives at the time of fixing, whereby the fixing performance can be improved.

Then, studies made on the surface treatment of magnetic fine particles with the low-softening substance (A) and on the fixing performance have revealed that a magnetic material having a high compressibility of 35 or more which is found from the following expression (1):

$$\text{compressibility}=(1-(\text{apparent density}/\text{tap density}))\times 100 \quad (1)$$

has good low-temperature fixing performance.

If the compressibility represented by the above expression is high, it means that "apparent density" is low or "tap density" is high. It, however, has been found that the "apparent density" does not change so much even when the surfaces of magnetic fine particles are treated with the low-softening substance (A) and that variations of compressibility are primarily caused by variations of tap density.

Accordingly, upon studying the variations of tap density, findings as stated below have been obtained.

When magnetic fine particles of the order of submicrons are treated with low-softening substance (A) of several μm to hundreds of μm merely by mixing and agitating them, a state is brought about in which the magnetic fine particles adhere to the low-softening substance (A) having large particle diameter. In the case of such a magnetic material, it by no means comes densely packed even when tapped, and hence a low tap density may result. Also where the magnetic fine particles have come stiffly agglomerated as a result of the treatment with the low-softening substance (A), they by no means come densely packed even when tapped, and hence a low tap density may result. On the other hand, where the surfaces of individual magnetic fine particles have uniformly been covered with the low-softening substance (A), the magnetic material is densely packed when tapped, resulting in a high tap density, and consequently a high compressibility.

More specifically, it can be considered that the fact that the magnetic material has a high compressibility is an index indicating that the surface treatment of magnetic fine particles with the low-softening substance (A) has uniformly been carried out.

The fact that the magnetic material has a high tap density also indicates that the magnetic material is less agglomerated and have good fluidity, where the magnetic material is well dispersed in toner particles.

Thus, in the magnetic toner of the present invention, it is presumed that the magnetic material the particle surfaces of which are uniformly covered with the low-softening substance (A) is dispersed well in toner particles, and hence the heat received at the time of fixing is effectively used for making the low-softening substance (A) melt and exude, and this improves the fixing performance of the toner.

On the other hand, if a magnetic material having a compressibility of less than 35 is used, i.e., when it is considered that the magnetic material is in a state that the magnetic fine particles adhere to the low-softening substance (A), the effect of improving low-temperature fixing performance of the toner cannot be sufficiently obtained. Also, in the toner having a small particle diameter of 10 μm or less as in the present invention, it is difficult for the magnetic material to be uniformly dispersed in toner particles, and the magnetic material tends to be present in toner particles in the form of agglomerates, where the magnetic material having a compressibility of less than 35 is so inferior in fluidity as to be more remarkably poorly dispersed. Hence, the low-softening substance (A) does not sufficiently melt and exude to further lower the effect of improving the low-temperature fixing performance. Also, if the magnetic material is in the state that the magnetic fine particles adhere to the low-softening substance (A), the above effect can not be expected, and besides, in suspension polymerization (described later) which can favorably produce the toner of the present invention, the low-softening substance (A) is difficult to enclose in particles or the low-softening substance (A) is present in the state that it is liberated from toner particles, tending to cause melt adhesion to a toner carrying member and to greatly cause fog.

Thus, it is reasonably considered that the use of the magnetic material surface-treated with the low-softening substance (A) and having the compressibility of 35 or more, which is more preferably 38 or more, enables the low-softening substance (A) to desirably exude at the time of fixing.

In the magnetic material obtained by treating the surfaces of magnetic fine particles with the low-softening substance (A), it is particularly preferred that the ratio (A-value) of the tap density of the magnetic fine particles which have been treated with the low-softening substance (A), to that of the magnetic material which have not been treated with the same, is in the following relationship:

(tap density of magnetic material/tap density of magnetic fine particles)=0.80 to 1.00 (more preferably 0.90 to 1.00).

Where the above relationship is satisfied, the treatment of individual magnetic fine particles with the low-softening substance (A) is considered to have been carried out in a very closely uniform state, bringing about a more remarkable effect of improving the low-temperature fixing performance.

A softening point Ts of the toner in measurement by a flow tester indicates the temperature at which the toner softens when it is heated, and means that one having a lower softening point is apt to be plasticized and deformed at lower temperature. Accordingly, one having a softening point higher than 85° C. may inhibit the low-temperature fixing performance because toner particles themselves are hard to plasticize and deform even though the low-softening substance (A) may exude well.

If on the other hand the toner has a softening point Ts of less than 40° C. in measurement by a flow tester, while having good low-temperature fixing performance, it is inferior in storage stability and tends to cause melt adhesion to the toner carrying member at the time of development, and also to deteriorates as a result of long-term service.

Accordingly, in the present invention, the toner should have a softening point Ts of from 40° C. to 85° C., and preferably 45° C. to 80° C., in measurement by a flow tester.

In the present invention, it is important that the THF(tetrahydrofuran)-insoluble matter of a binder resin component of the toner is from 1% to 60% (by weight). Where the THF-insoluble matter is 1% or more, the toner can be prevented from having an excessively low melt viscosity at the time of fixing at high temperature, and can be improved in high-temperature anti-offset properties because of a synergistic effect with the exudation of the low-softening substance (A) present at particle surfaces of the magnetic material, making it possible to achieve superior fixing performance in a broad temperature range. If, however, the binder resin component of the toner has more than 60% of the THF-insoluble matter, the resin component being plasticized and melted is in so small a content that the low-temperature fixing performance tends to come poor, making it difficult to achieve good fixing performance.

Accordingly, in the magnetic toner of the present invention, it is important for the resin component to have from 1% to 60%, and preferably from 10% to 55%, of the THF-insoluble matter.

As having been described above, the present inventors consider that the toner can have superior low-temperature fixing performance and high-temperature anti-offset properties and have good fixing performance in a broad fixing temperature range in virtue of a synergistic effect of the following points (1) to (3):

(1) the use of the magnetic material treated uniformly with the low-softening substance (A) makes the low-softening substance (A) exude very well at the time of fixing:

(2) the toner is readily plasticized and deformed because of its softening point Ts of from 40° C. to 85° C.; and (3) the toner has superior high-temperature anti-offset properties because of its resin component having 1% to 60% of the THF-insoluble matter.

In addition, the apparent density and tap density of the magnetic material are measured according to JIS K 5101. In regard to the tap density, the number of times of tapping is set to be 600 times to make measurement. In measuring the apparent density and tap density, a powder tester manufactured by Hosokawa Micron Corporation may be used, for example.

The THF-insoluble matter of the resin component of the toner is measured in the following way.

The toner is precisely weighed in an amount of 1 g, which is then put in a cylindrical filter paper and is subjected to Soxhlet extraction for 20 hours using 200 ml of THF. Thereafter, the cylindrical filter paper is taken out, and then vacuum-dried at 40° C. for 20 hours to measure the weight of residues. The THF-insoluble matter is calculated according to the following equation. Here, the resin component of toner refers to the component obtained by removing components other than the resin, such as the magnetic fine particles, a charge control agent, a release agent component (inclusive of the low-softening substance (A)), external additives and a pigment from the toner. In the measurement of the THF-insoluble matter, taking into account whether these contents are soluble or insoluble in THF, the THF-insoluble matter on the basis of the resin component is calculated.

$$\text{THF-insoluble matter (\%)}=[(W2-W3)/(W1-W3-W4)]\times 100$$

wherein W1 is the weight of toner; W2 is the weight of residues; W3 is the weight of components insoluble in THF, other than the resin component of toner; and W4 is the weight of components soluble in THF, other than the resin component of toner.

The THF-insoluble matter of the resin component of toner is arbitrarily controllable depending on the type of binder resin and the conditions of kneading in the case where the toner is produced by pulverization. In the case where produced by polymerization, it is also arbitrarily controllable depending on the types of initiator and cross-linking agent and combination with their amounts and so forth. The THF-insoluble matter is also controllable by using a chain transfer agent.

The softening point Ts of the magnetic toner of the present invention is measured with a flow tester CFT-500 Type (manufactured by Shimadzu Corporation). A toner passing through 60 meshes (opening: 250 μm) is weighed in an amount of about 1.5 g, and is pressed using a molding unit for 1 minute under application of a pressure of 100 kg/cm$^2$ (9,800 kPa).

To this sample, a load of 10 kgf (98 N) is applied, the level of fall of a plunger of the flow tester is measured by the heating method under the conditions of a temperature rise of 4.0° C./min, a die diameter of 1.0 mm and a die length of 1.0 mm, to obtain a flow curve as shown in FIG. 1, finding the softening point Ts.

As the low-softening substance (A) used in the surface treatment of magnetic fine particles, it may be a substance having endothermic peaks at the time of heating in the measurement with a differential scanning calorimeter (DSC), where the peak top of the endothermic peaks (endothermic peak top) is preferably in the range of from 80° C. to 150° C., and more preferably in the range from 80° C. to 130° C. If the endothermic peak top is in a range higher than 150° C., the low-softening substance (A) itself is difficult to melt unless a high temperature is used, resulting in poor low-temperature fixing performance. If on the other hand the peak top of the endothermic peaks is in a range less than 80° C., part of the low-softening substance may dissolve out to a polymerization monomer system in the suspension polymerization preferably used in the present invention, so that the effect of treatment may lower.

The low-softening substance (A) used in the treatment of magnetic fine particles may preferably be in an amount of from 0.3 to 15 parts by weight based on 100 parts by weight of the magnetic fine particles. If the low-softening substance (A) used in the treatment is in an amount of less than 0.3 part by weight, no sufficient releasability may be obtained, resulting in poor fixing performance. If on the other hand it is in an amount of more than 15 parts by weight, the magnetic material tends to agglomerate when surface-treated with the low-softening substance (A), and also the low-softening substance (A) may come liberated in a large quantity, which is not preferred.

The low-softening substance (A) of the magnetic material may also preferably be in a liberation percentage of 25% or less, and more preferably 15% or less. The liberation percentage of the low-softening substance (A) is one found from the following expression (2). It means that the larger this value is, the greater the tendency for the low-softening substance (A) to be liberated from magnetic-material particle surfaces is or the more the liberated low-softening substance (A) is. In this case, e.g., in the suspension polymerization, granulation cannot be satisfactorily carried out, and hence the resultant toner may have a broad particle size distribution. In addition, part of the liberated low-softening substance (A) is present in the state it is liberated from toner particles, and so it may cause melt adhesion to the toner carrying member or may greatly cause fog, which is not preferred. In addition, the liberation percentage of the low-softening substance (A) of the magnetic material depends on the melting point, quantity, particle diameter and so forth of the low-softening substance (A) used.

$$\text{Liberation percentage}=(1-B/A)\times 100 \quad (2).$$

wherein A is the endothermic quantity of the magnetic material, which is the value measured with the DSC (differential scanning calorimeter), and B is the endothermic quantity measured with the DSC on a sample prepared by adding 10 g of the magnetic material to 200 ml of methanol, dispersing the former in the latter by means of an ultrasonic dispersion unit, thereafter collecting the magnetic material with a magnet, followed by drying.

The endothermic quantity and endothermic peak top of the magnetic material is measured according to ASTM D3418-8. For the measurement, for example, DSC-7, manufactured by Perkin-Elmer Corporation, DSC2920, manufactured by TA Instruments Japan Ltd., or Q1000, manufactured by TA Instruments Japan Ltd., may be used. The temperature at the detecting portion of the device is corrected on the basis of the melting points of indium and zinc, and the amount of heat is corrected on the basis of heat of fusion of indium. The sample for measurement is put in a pan made of aluminum and an empty pan is set as a control. A DSC curve is used which is measured when the sample is heated once up to 200° C. and, after heat history is removed, cooled rapidly, then again heated at a heating rate of 10° C./min in the temperature range of from 30 to 200° C. The measurement is made in the same manner also in Examples given later.

As the low-softening substance (A) with which the surfaces of magnetic fine particles are to be treated, any of known wax and crystalline polyester may be used.

The wax may include, e.g., petroleum waxes such as paraffin wax, microcrystalline wax and petrolatum, and derivatives thereof; montan wax and derivatives thereof; hydrocarbon waxes obtained by Fischer-Tropsch synthesis, and derivatives thereof; polyolefin waxes typified by polyethylene wax, and derivatives thereof; and naturally occurring waxes such as carnauba wax and candelilla wax, and derivatives thereof. The derivatives include oxides, block copolymers with vinyl monomers, and graft modified products. Also usable are higher aliphatic alcohols, fatty acids or compounds thereof, acid amide waxes, ester waxes, ketones, hardened caster oil and derivatives thereof, vegetable waxes, and animal waxes.

The crystalline polyester may be obtained by the reaction of a dibasic or higher polybasic carboxylic acid with diols. In particular, a polyester composed chiefly of an aliphatic diol and an aliphatic dicarboxylic acid is preferred as having a high crystallinity.

As an alcohol monomer for obtaining such a crystalline polyester, it may include ethylene glycol, diethylene glycol, 1,2-propylene glycol, 1,3-propylene glycol, 1,4-butanediol, trimethylene glycol, tetramethylene glycol, pentamethylene glycol, hexamethylene glycol, octamethylene glycol, nonamethylene glycol, decamethylene glycol, neopentyl glycol, cyclohexanedimethanol, polyoxyethylene type bisphenol A, polyoxypropylene type bisphenol A, and others.

As a carboxylic acid monomer for obtaining the crystalline polyester, it may include malonic acid, succinic acid, glutaric acid, adipic acid, pimelic acid, suberic acid, glutaconic acid, azelaic acid, sebacic acid, nonanedicarboxylic acid, decanedicarboxylic acid, undecanedicarboxylic acid, dodecanedicarboxylic acid, fumaric acid, mesaconic acid, citraconic acid, itaconic acid, isophthalic acid, terephthalic acid, cyclohexanedicarboxylic acid, as well as anhydrides or lower alkyl esters of these acids, and others.

As equipment for treating the surfaces of magnetic fine particles with the low-softening substance (A), an apparatus which can apply shear force is preferred. In particular, apparatus which can simultaneously apply shearing, spatulate action and compression may preferably be used, as exemplified by a wheel type kneader, a ball type kneader and a roll type kneader. Of these, from the viewpoint of uniform treatment, it is preferable to use a wheel type kneader. By the use of the wheel type kneader, treatment can be carried out so that the low-softening substance is rubbed against, and made to adhere to, and spread on, the surfaces of magnetic fine particles. Thus, the surfaces of magnetic fine particles can uniformly be covered with the low-softening substance.

The above wheel type kneader may specifically include an edge runner mill, a multi-mill, Stotz mill, a wet-pan mill, Conner mill and a ring muller. It may preferably be an edge runner mill, a multiple mill, Stotz mill, a wet-pan mill or a ring muller, and more preferably be an edge runner mill. Also, the ball type kneader may include a vibration mill, and the roll type kneader may include an extruder.

In the case where the edge runner mill is used, the linear load at its treating section may preferably be from 19.6 to 1,960 N/cm (2 to 200 kg/cm), more preferably from 98 to 1,470 N/cm (10 to 150 kg/cm), and still more preferably from 147 to 980 N/cm (15 to 100 kg/cm) so that the surfaces of magnetic fine particles can uniformly be treated and covered with the low-softening substance (A). Treatment may be carried out for 15 to 180 minutes, and preferably for 30 to 150 minutes. If the treatment time is shorter than 15 minutes, the surfaces of magnetic fine particles can not completely be treated with the low-softening substance (A), resulting in a rise in liberation percentage of the low-softening substance (A). If on the other hand the treatment time is longer than 180 minutes, agglomeration may take place because of the heat generated by the treatment, resulting in a low compressibility. In addition, agitation may be carried out at a speed of from 2 to 2,000 rpm, preferably from 5 to 1,000 rpm, and more preferably from 10 to 800 rpm, while the treatment conditions are appropriately adjusted.

The low-softening substance (A) used in the treatment of magnetic fine particles may also preferably be 500 μm or less in particle diameter. If it has particle diameter larger than this, it may be difficult to carry out uniform treatment and also a large liberation percentage may result. In addition, the particle diameter of the low-softening substance (A) may be measured with a laser diffraction/scattering particle size distribution measuring instrument LA-920 (manufactured by Horiba Ltd.), and volume-average particle diameter is regarded as the particle diameter of the low-softening substance (A).

The magnetic material used in the magnetic toner of the present invention may preferably be one in which the magnetic fine particles have been surface-treated with a coupling agent and thereafter surface-treated with the low-softening substance (A).

As described above, the magnetic material in the present invention is one obtained by treating the surfaces of magnetic fine particles with the low-softening substance (A). The magnetic fine particles are inorganic matter and the low-softening substance (A) is an organic compound, and hence, it is difficult to cover the magnetic fine particles surfaces uniformly with the low-softening substance (A) even when using the treating equipment described above. Accordingly, the magnetic fine particle surfaces may previously be treated with a coupling agent so that they can uniformly be treated with the low-softening substance (A) through the coupling agent.

In the suspension polymerization, the treatment with the coupling agent can increase the hydrophobicity of the magnetic material itself and can enhance the degree of enclosure of the magnetic material, and hence the developing performance can be improved.

Here, as a method for treating the magnetic fine particle surfaces with the coupling agent, two methods are commonly available which are dry-process treatment and wet-process treatment. In the present invention, the treatment may be carried out by either method. When treated by the dry-process, the treatment may be carried out using the same equipment as the treating apparatus preferable for the treatment with the low-softening substance (A).

When treated by the wet-process, a method may be preferable in which the magnetic fine particles are so dispersed in an aqueous medium as to have primary particle diameter, during which their surfaces are treated while hydrolyzing the coupling agent. It is more preferable that magnetic fine particles produced in an aqueous solution are washed, and thereafter subjected to hydrophobic treatment without being dried.

Here, the aqueous medium refers to a medium composed chiefly of water. Stated specifically, it may include water itself, water to which a surface-active agent has been added in a small quantity, water to which a pH adjuster has been added, and water to which an organic solvent has been added. As the surface-active agent, nonionic surface-active agents such as polyvinyl alcohol are preferred. The surface-active agent may be added in an amount of from 0.1 to 5.0% by weight based on the water. The pH adjuster may include inorganic acids such as hydrochloric acid. The organic solvent may include alcohols.

The coupling agent usable in the surface treatment of the magnetic fine particles according to the present invention may include, e.g., silane coupling agents and titanium coupling agents. Preferred are the use of silane coupling agents, which are those represented by the following formula:

$$R_mSiY_n$$

wherein R represents an alkoxyl group; m represents an integer of 1 to 3; Y represents a functional group such as an alkyl group, a vinyl group, an epoxy group or a methacrylic group; and n represents an integer of 1 to 3; provided that m+n=4.

The silane coupling agents represented by the above formula may include, e.g., vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyltrimethoxysilane, n-decyltrimethoxysilane, hydroxypropyltrimethoxysilane, n-hexadecyltrimethoxysilane and n-octadecyltrimethoxysilane.

Of these, from the viewpoint of achievement of high hydrophobicity, an alkyltrialkoxysilane coupling agent represented by the following formula may preferably be used.

$$C_pH_{2p+1}—Si—(OC_qH_{2q+1})_3$$

wherein p represents an integer of 2 to 20, and q represents an integer of 1 to 3.

In the above formula, if p is smaller than 2, it is difficult to provide sufficient hydrophobicity. If p is larger than 20, though hydrophobicity can be sufficient, the magnetic fine particles may greatly coalesce with one another, which is undesirable. If q is larger than 3, the silane coupling agent may have low reactivity to make it hard for the magnetic fine particles to be made sufficiently hydrophobic. It is also more preferable that the p in the formula represents an integer of 3 to 15 and the q represents an integer of 1 or 2.

In addition, in the case where the above silane coupling agent is used, the treatment may be carried out using it alone, or using a plurality of types in combination. When used in combination, the treatment may be carried out using the respective coupling agents separately, or using them simultaneously.

The silane coupling agent(s) used in the treatment may be in an amount of from 0.05 to 20 parts by weight, preferably from 0.1 to 10 parts by weight, in total, based on 100 parts by weight of the magnetic fine particles. The amount of such a treating agent may preferably be adjusted in accordance with the surface area of the magnetic fine particles and the reactivity of the coupling agent.

The magnetic fine particles used in the magnetic toner of the present invention may preferably be those composed chiefly of iron oxide such as triiron tetraoxide or γ-iron oxide, which may contain any of elements such as phosphorus, cobalt, nickel, copper, magnesium, manganese, aluminum and silicon. The magnetic fine particles may also be used in a combination of two or more types.

As the shape of such magnetic fine particles, they may be polyhedral (e.g., octahedral or hexahedral), spherical, acicular or flaky. Octahedral, hexahedral or spherical ones are preferred as having less anisotropy, which are preferable in order to improve image density.

The magnetic material may preferably have a BET specific surface area, in measurement by nitrogen gas adsorption, of from 2 to 30 $m^2/g$, and particularly from 3 to 28 $m^2/g$, and also may preferably have a Mohs hardness of from 5 to 7.

The magnetic material may preferably have a volume-average particle diameter of from 0.05 to 0.40 μm. If the magnetic material has a volume-average particle diameter of less than 0.05 μm, it may provide insufficient coloring power (or tinting power) when used as a colorant of black toners, and besides the magnetic material is apt to agglomerate, tending to be inferior in uniformity of the treatment with the low-softening substance (A). If on the other hand the magnetic material has a volume-average particle diameter of more than 0.40 μm, it may have insufficient coloring power. In addition, especially when used as a colorant for toners having small particle diameters, it may be difficult as a matter of probability to disperse the magnetic material uniformly in individual toner base particles, tending to result in a poor dispersibility, which is undesirable.

The volume-average particle diameter of the magnetic material may be measured with a transmission electron microscope. Stated specifically, 10 g of the magnetic material is added to 200 ml of methanol and then dispersed for 30 minutes by means of an ultrasonic dispersion machine, and thereafter the magnetic material is collected with a magnet, followed by drying. This magnetic material is sufficiently dispersed in epoxy resin, followed by curing for 2 days in an environment of temperature 40° C. to obtain a cured product, which is then cut out in slices by means of a microtome to prepare a sample, where the particle diameters of 100 magnetic fine particles in the visual field are measured on a photograph taken at 10,000 to 40,000 magnifications using a transmission electron microscope (TEM). Then, the volume-average particle diameter is calculated on the basis of circle-equivalent diameters equal to the projected areas of the magnetic materials. The particle diameter may also be measured with an image analyzer. In addition, in measuring the average particle diameter of the magnetic material, the low-softening substance (A) liberated from magnetic fine particles has been removed by the treatment with an ultrasonic dispersion machine.

In the present invention, in addition to the magnetic material, other colorants may also be used in combination. Such a colorant usable in combination may include magnetic or non-magnetic inorganic compounds and known dyes and pigments. Stated specifically, it may include, e.g., ferromagnetic metal particles of cobalt, nickel and the like, or particles of alloys of any of these metals to which chromium, manganese, copper, zinc, aluminum, a rare earth element or the like has been added; and particles of hematite, titanium black, nigrosine dyes or pigments, carbon black, and phthalocyanines. These may also be used after their particle surface treatment.

The magnetic material used in the magnetic toner of the present invention may preferably be used in an amount of from 10 to 200 parts by weight based on 100 parts by weight of the binder resin. It may more preferably be used in an amount of from 20 to 180 parts by weight. If it is less than 10 parts by weight, the magnetic toner, though having good fixing performance, may have poor coloring power, also making it difficult to keep fog from being caused. If on the other hand it is more than 200 parts by weight, the magnetic toner may have poor fixing performance and also be held on the toner-carrying member by magnetic force so strong as to have a low developing performance, which is undesirable.

The content of the magnetic material in the magnetic toner may be measured with a thermal analyzer TGA7, manufactured by Perkin-Elmer Corporation. As the measuring method, the magnetic toner is heated at a heating rate of 25° C./minute from normal temperature to 900° C. in an atmosphere of nitrogen. The weight loss in the course of from 100° C. to 750° C. is regarded as binder resin weight, and the residual weight is approximately regarded as magnetic material weight. The content of the magnetic material is calculated from the proportion of the two.

In the case where magnetic iron oxide particles are used as the magnetic fine particles used in the magnetic toner of the present invention, such particles may be produced in the following way.

To an aqueous ferrous salt solution, an alkali such as sodium hydroxide is added in an equivalent weight, or more than equivalent weight, with respect to the iron component to prepare an aqueous solution containing ferrous hydroxide. Into the aqueous solution thus prepared, air is blown while the pH of the solution is maintained at pH 7 or above (preferably pH 8 to pH 14), and the ferrous hydroxide is made to undergo oxidation reaction while the aqueous solution is heated to 70° C. or above to first form seed crystals serving as cores of magnetic ion oxide particles.

Next, to a slurry-like liquid containing the seed crystals, an aqueous solution containing ferrous sulfate in about one equivalent weight on the basis of the quantity of the alkali previously added is added. The reaction of the ferrous hydroxide is continued while the pH of the liquid is maintained at 6 to 14 and air is blown, to cause magnetic fine iron oxide particles to grow around the seed crystals as cores. At this point, any desired pH may be selected to control the shape of the magnetic particles. With the progress of oxidation reaction, the pH of the liquid shifts on to acid side, but it is preferable for the pH of the liquid not to be made less than 6.

Where the magnetic ion oxide particles obtained are surface-treated, they may subsequently be treated in the following way. Where they are surface-treated by the dry process after the oxidation reaction was completed, the magnetic material obtained after washing, filtration and drying is subjected to surface treatment with the coupling agent or low-softening substance (A). Also, where the magnetic ion oxide particles are surface-treated by the wet process, those having been dried after the oxidation reaction has been completed are again dispersed. Alternatively, the iron oxide particles obtained after the oxidation reaction is completed, followed by washing and filtration, may be again dispersed in a different aqueous medium without drying, and the pH of the dispersion again formed may be adjusted to the acid side, where the silane coupling agent may be added with thorough stirring, and the temperature may be raised after hydrolysis or the pH may adjusted to the alkaline side to carry out coupling treatment. After the surface treatment with the coupling agent in this way, the ion oxide particles are surface-treated with the low-softening substance (A) in such a manner as described previously.

Here, as the ferrous salt, it is possible to use iron sulfate commonly formed as a by-product in the production of titanium by the sulfuric acid method, or iron sulfate formed as a by-product in surface washing of steel sheets, and it is also possible to use iron chloride.

In the process of producing the iron oxide particles by the aqueous solution method, considering that the viscosity is prevented from increasing at the time of reaction and the solubility of the iron sulfate, the iron sulfate is commonly used in an iron concentration of from 0.5 to 2 mol/l. Commonly, there is such a tendency that the lower the concentration of iron sulfate is, the finer the particle size of the products is. Also, in the reaction, there is such a tendency that the more the air is and the lower the reaction temperature is, the finer particles are.

The magnetic toner of the present invention may preferably be one having a magnetization intensity of from 10 to 50 $Am^2/kg$ (10 to 50 emu/g) in a magnetic field of 79.6 kA/m (1,000 oersteds). In using the magnetic toner, a method is commonly employed in which a magnetism generation means is provided in a developing assembly to prevent the magnetic toner from leaking. As long as the magnetization intensity is 10 $Am^2/kg$ or more, the toner can sufficiently be kept from leaking. Also, a sufficient effect can be obtained also from the viewpoint of the transport performance and agitation performance of the toner and the prevention of toner scatter. However, if the magnetic toner has a magnetization intensity of less than 10 $Am^2/kg$ in a magnetic field of 79.6 kA/m, the above effect is not sufficiently obtainable. In addition, where the magnetic force is made to act on the toner-carrying member, the magnetic toner may be unstably formed into ears, tending to cause uneven image density. Also, the magnetic toner may not be uniformly charged to cause fog greatly.

If on the other hand the magnetic toner has a magnetization intensity of more than 50 $Am^2/kg$ under the application of a magnetic field of 79.6 kA/m, the magnetic toner may have very low fluidity because of magnetic agglomeration to cause a lowering in developing performance, and also the magnetic toner may greatly deteriorate, which is undesirable.

In addition, the magnetization intensity of the magnetic toner is arbitrarily changeable depending on the type, quantity and so forth of the magnetic material to be contained.

In the present invention, the magnetization intensity of the magnetic toner is measured with a vibration type magnetic-force meter VSM P-1-10 (manufactured by Toei Industry, Co., Ltd.) under the application of an external magnetic field of 79.6 kA/m at room temperature of 25° C. The reason therefor is that since the magnetic force of development poles of a magnet roller set stationarily in the toner carrying member is about 1,000 oersteds, the behavior of toner in the development zone can be taken into account by measuring the magnetization intensity under the application of the external magnetic field of 79.6 kA/m.

The magnetic toner of the present invention faithfully develops more minute latent image dots in order to improve image quality. Hence, it is important for the toner to have the weight-average particle diameter of from 3 μm to 10 μm, and preferably from 4 μm to 9 μm. Also, the smaller the particle diameter of the toner is, the better the fixing performance is. From the viewpoint of this as well, the toner must have a particle diameter of 10 μm or less.

The reason therefor is uncertain, but is considered as follows: Where a toner has small particle diameter, toner particles per unit weight are in a large number, and toner particles have many contact points with one another. Hence, toner particles having been plasticized and deformed by the heat from the fixing assembly can readily stick together, thereby improving the fixing performance.

For the foregoing reasons, it is preferable for the toner to have a smaller weight-average particle diameter to a certain extent. However, if the weight-average particle diameter is less than 3 μm, the fluidity and agitation performance as powder may be lowered, so that individual toner particles may be difficult to uniformly charge, and besides, fog may be greatly caused.

The magnetic toner of the present invention may preferably have a variation coefficient of 40 or less, and more preferably 30 or less, in number distribution. A variation coefficient of more than 40 in number distribution means that the magnetic toner has a broad particle size distribution, which may cause selective development or make the toner have inferior charge uniformity, and may cause fog greatly.

Here, the variation coefficient in number distribution is a value found according to the following expression (3):

$$\text{Variation coefficient} = ((\text{Standard deviation of number distribution}) / \text{number-average particle diameter of toner})) \times 100 \quad (3).$$

The weight-average particle diameter and particle size distribution of the magnetic toner may be measured by various methods making use of Coulter Counter Model TA-II or Coulter Multisizer (manufactured by Coulter Electronics, Inc.). In the present invention, Coulter Multisizer (manufactured by Coulter Electronics, Inc.) is used. An interface (manufactured by Nikkaki Bios Co.) that outputs number distribution and volume distribution and a personal computer PC9801 (manufactured by NEC.) are connected. As an electrolytic solution, a 1% NaCl aqueous solution is prepared using first-grade sodium chloride. For example, ISOTON R-II (available from Coulter Scientific Japan Co.) may be used.

Measurement is carried out by adding as a dispersant 0.1 ml to 5 ml of a surface active agent (preferably alkylbenzene sulfonate) to 100 ml to 150 ml of the above aqueous electrolytic solution, and further adding 2 ml to 20 mg of a sample to be measured. The electrolytic solution in which the sample has been suspended is subjected to dispersion treatment for about 1 minute to about 3 minutes in an ultrasonic dispersion machine. The number distribution is calculated by measuring the number of toner particles with particle diameters of 2 μm or more by means of the above Coulter Multisizer, using an aperture of 100 μm as its aperture. Then, the number-based, length-average particle diameter determined from the number distribution, i.e., the number-average particle diameter, and the standard deviation of the number distribution are determined. The same measurement as in the above was carried out also in Examples given later.

The magnetic toner of the present invention may preferably have an average circularity of from 0.960 to 1.000. In as much as the magnetic toner has an average circularity of 0.960 or more, the magnetic toner can be formed into uniform and fine ears at the developing zone and can perform development faithful to latent images, so that highly minute images can be obtained. Further, the use of such a toner is preferable because there are very few voids in the toner layer after development and hence the contact points between toner particles with each other increase, bringing about an improvement in fixing performance.

The magnetic toner of the present invention may also have a mode circularity of 0.99 or more in its circularity distribution. This means that most toner particles have a shape close to a true sphere. This is preferable because the above action can be more remarkable.

The average circularity referred to in the present invention is used as a simple method for expressing the shapes of particles quantitatively. In the present invention, the shapes of particles are measured with a flow type particle image analyzer FPIA-1000, manufactured by Toa Iyou Denshi K.K., and the circularity (Ci) of each particle measured on a group of particles having a circle-equivalent diameter of 3 μm or more is individually determined according to the following expression (4). As further shown in the following expression (5), the value obtained by dividing the sum total of circularities of all the measured particles by the number (m) of particles is defined as the average circularity (C).

$$\text{Circularity (Ci)} = \frac{\text{Circumferential length of a circle with the same projected area as particle image}}{\text{Circumferential length of particle projected image}} \quad (4)$$

$$\text{Average circularity } (\overset{m}{\underset{i=1}{C}}) = \Sigma \text{Ci/m} \quad (5)$$

The mode circularity refers to a peak circularity at which the value of frequency in circularity frequency distribution comes to be the maximum when the circularity range of 0.40 to 1.00 is divided into 61 ranges at 0.01 intervals (i.e., 0.40 or more to less than 0.41, . . . , 0.99 or more to less than 1.00 and 1.00) and the circularities of particles thus measured are assigned to each of the 61 ranges in accordance with the corresponding circularity. Herein, the lower limit in each channel is employed as the mode circularity.

The measuring device "FPIA-1000" used in the present invention employs a calculation method in which, in calculating the circularity of each particle and then calculating the average circularity, particles are classified into classes such that the circularity range of 0.40 to 1.00 are divided into 61 ranges, in accordance with their circularities obtained, and the average circularity is calculated using the center values and frequencies of divided points. However, between the values of the average circularity calculated by this calculation method and the values of the average circularity calculated by the above calculation equation which uses the circularity of each particle directly, there is only a very small difference which is at a level that is substantially negligible. Accordingly, in the present invention, a calculation method can be used in which the concept of the calculation equation which uses the circularity of each particle directly is utilized and is partly modified, for the reason of processing data, e.g., shortening the calculation time and simplifying the operational equation for calculation.

The measurement is made in the procedure as shown below.

In 10 ml of water in which about 0.1 mg of a surface-active agent has been dissolved, about 5 mg of the magnetic toner is dispersed to prepare a dispersion. Then, the dispersion is exposed to ultrasonic waves (20 kHz , 50 W) and the dispersion is made to have a concentration of 5,000 to 20,000 particles/μl, where the measurement is made using the above analyzer to determine the average circularity and mode circularity of the group of particles having a circle-equivalent diameter of 3 μm or larger.

The average circularity referred to in the present invention is an index showing the degree of surface unevenness of magnetic toner particles. It is indicated as 1.000 when the particles are perfectly spherical. The more complicate the surface shapes of magnetic toner particles are, the smaller the value of average circularity is.

In the above measurement, the reason why the circularity is measured only on the group of particles having a circle-equivalent diameter of 3 μm or larger is that particles of external additives that are present independently of toner particles are included in a large number in particles having a circle-equivalent diameter smaller than 3 μm, which may affect the measurement not to enable the circularities of toner particles to be accurately estimated.

The magnetic toner of the present invention may also be mixed with a charge control agent. As the charge control agent, any known charge control agents may be used. In particular, charge control agents which have a high charging speed and also can maintain a constant charge quantity are preferred. In the case where the magnetic toner particles are directly produced by polymerization, it is preferable to use charge control agents low in polymerization inhibitory action and substantially free of solubilizates into the aqueous dispersion medium. As specific compounds, they may include, as negative charge control agents, metal compounds of aromatic carboxylic acids such as salicylic acid, alkylsalicylic acids, dialkylsalicylic acids, naphthoic acid and dicarboxylic acid; metal salts or metal complexes of azo dyes or azo pigments; polymer type compounds having sulfonic acid or carboxylic acid in the side chain; as well as boron compounds, urea compounds, silicon compounds, and carixarene. As positive charge control agents, they may include quaternary ammonium salts, polymer type compounds having such a quaternary ammonium salt in the side chain, guanidine compounds, Nigrosine compounds and imidazole compounds.

As a method for making toner base particles contain the charge control agent, a method of internally adding it to the toner base particles is available. For example, in the case where suspension polymerization is carried out, a method is common in which the charge control agent is added to a polymerizable monomer composition before granulation. The charge control agent has been dissolved or suspended in a polymerizable monomer in the midst of forming oil droplets in water to effect polymerization, or after the polymerization, and the polymerizable monomer with the charge control agent dissolved or suspended therein may be added and seed polymerization is carried out so as to uniformly cover toner particle surfaces. Also, where the charge control agent is externally added to toner base particles, an organometallic compound may be used as the charge control agent, and the toner base particles and the organometallic compound may be mixed and agitated under the application of shear to provide toner base particles with the charge control agent.

The quantity of the charge control agent used depends on the type of the binder resin, the presence of any other additives, and the manner by which the toner is produced, inclusive of the manner of dispersion, and can not be absolutely specified. Preferably, when internally added, the charge control agent may be used in an amount ranging from 0.1 to 10 parts by weight, and more preferably from 0.1 to 5 parts by weight, based on 100 parts by weight of the binder resin. When externally added to the magnetic toner particles, it may preferably be added in an amount of from 0.05 to 1.0 part by weight, and more preferably from 0.01 to 0.3 part by weight, based on 100 parts by weight of the toner.

In order to further improve fixing performance, the magnetic toner of the present invention may preferably further contain a low-softening substance (B) in an amount of from 1 to 20 parts by weight based on 100 parts by weight of the binder resin, and it is preferable that its endothermic peak top is in the range from 40° C. to 80° C. It is also preferable that the low-softening substance (B) has a melting point which is at least 5° C. lower than the melting point of the low-softening substance (A).

In the present invention, the particle surfaces of the magnetic material are treated with the low-softening substance (A). By further incorporating the low-softening substance (B), fixing performance can be improved because an exuding amount of low-softening substances can be increased. In particular, when the low-softening substance (A) with which the surfaces of magnetic fine particles are to be treated has the endothermic peak top in the range of 80° C. to 150° C., it is preferred that one having an endothermic peak top of 40° C. to 80° C. is further added as the low-softening substance (B) because its effect can be very great. Also, if the low-softening substance (B) is added in an amount of less than 1 part by weight based on 100 parts by weight of the binder resin, the effect exhibited by the addition of the low-softening substance (B) may be low. If on the other hand it is in an amount of more than 20 parts by weight, the toner may be lowered in long-term storage stability, and also the low-softening substance may exude to toner particle surfaces to lower the charge uniformity of the toner, which is undesirable. In addition, since a large quantity of wax is enclosed in toner base particles, the shape of toner particles tends to become distorted.

As the low-softening substance (B) to be further added, any known release agents may be used, which may include petroleum waxes such as paraffin wax, microcrystalline wax and petrolatum, and derivatives thereof; montan wax and derivatives thereof; hydrocarbon waxes obtained by Fischer-Tropsch synthesis, and derivatives thereof; polyolefin waxes typified by polyethylene wax, and derivatives thereof; and naturally occurring waxes such as carnauba wax and candelilla wax, and derivatives thereof. The derivatives include oxides, block copolymers with vinyl monomers, and graft modified products. Also usable are higher aliphatic alcohols, fatty acids such as stearic acid and palmitic acid, or compounds thereof, acid amide waxes, ester waxes, ketones, hardened caster oil and derivatives thereof, vegetable waxes, and animal waxes.

The endothermic peak top temperature of such a low-softening substance (B) may be measured according to ASTM D3417-99.

The magnetic toner of the present invention may preferably have the peak top of the main peak in the molecular weight region of from 5,000 to 50,000, and more preferably in the region of from 8,000 to 40,000, in its molecular weight distribution in measurement by gel permeation chromatography (GPC) of the THF-soluble resin component of the toner. If the peak top is in the molecular weight region of less than 5,000, a problem may be raised in the storage stability of the toner, or the toner may greatly deteriorate when printed on a large number of sheets. If on the other hand the peak top is in the molecular weight region of more than 50,000, the toner may have a problem on low-temperature fixing performance, which is undesirable.

The molecular weight of a resin component soluble in THF may be measured by GPC in the following way.

A solution prepared by dissolving the magnetic toner in THF at room temperature for 24 hours at rest is filtered with a solvent-resistant membrane filter of 0.2 μm in pore diameter to prepare a sample solution, which is then measured under such conditions as shown below. To prepare the sample, the quantity of THF is so controlled that the component soluble in THF is in a concentration of from 0.4 to 0.6% by weight.

Apparatus: High-speed GPC HLC8120 GPC (manufactured by Tosoh Corporation).

Columns: Combination of seven columns, Shodex KF-801, KF-802, KF-803, KF-804, KF-805, KF-806 and KF-807 (available from Showa Denko K.K.).

Eluent: THF.

Flow rate: 1.0 ml/min.

Oven temperature: 40.0° C.

Amount of sample injected: 0.10 ml.

To calculate the molecular weight of the sample, a molecular weight calibration curve is used which is prepared using a standard polystyrene resin (TSK Standard Polystyrene F-850, F-450, F-288, F-128, F-80, F-40, F-20, F-10, F-4, F-2, F-1, A-5000, A-2500, A-1000, A-500, available from Tosoh Corporation).

The magnetic toner of the present invention may preferably have a glass transition point (Tg) of from 30° C. to 80° C., and more preferably from 35° C. to 70° C. If the Tg is lower than 30° C., the magnetic toner may be inferior in storage stability. If the Tg is higher than 80° C., the magnetic toner may be inferior in fixing performance. The glass transition point of the magnetic toner may be measured with, e.g., a differential scanning calorimeter. The measurement is made according to ASTM D3418-99. In the measurement, a sample is once heated to erase a previous history and thereafter rapidly cooled. The sample is again heated at a heating rate of 10° C./min within a temperature range of from 10 to 200° C., and the DSC curve measured in the course of heating is used.

The magnetic toner of the present invention may be produced by any known methods. First, where it is produced by pulverization, for example, components such as the binder resin, the magnetic material, and besides optionally the release agent (low-softening substance (B)), the charge control agent and the colorant, and other additives, are thoroughly mixed by mean of a mixer such as Henschel mixer or a ball mill, thereafter the mixture obtained is melt-kneaded by means of a heat kneading machine such as a heat roll, a kneader or an extruder to melt the resin and so forth, in which other toner materials such as the magnetic material are dispersed or dissolved. The resultant kneaded product is cooled to solidify, followed by pulverization, classification and optionally surface treatment to obtain toner base particles. In the case where the surface treatment is carried out, either of the classification and the surface treatment may be first in order. In the step of classification, a multi-division classifier may preferably be used in view of production efficiency. In addition, the toner base particles themselves may be used as the toner. External additives may be added to the toner base particles, and such particles may be used as the toner.

The pulverization step may be carried out by any method making use of a known pulverizer such as a mechanical impact type or a jet type. In order to obtain the magnetic toner having the preferable circularity (0.960 or more) according to the present invention, it is preferable to further apply heat to effect pulverization or to apply mechanical impact subsidiarily. Also usable are a hot-water bath method in which toner base particles finely pulverized (and optionally classified) are dispersed in hot water, and a method in which the toner base particles are passed through hot-air stream.

As means for applying mechanical impact force, available are, e.g., a method making use of a mechanical impact type pulverizer such as Kryptron system, manufactured by Kawasaki Heavy Industries, Ltd., or Turbo mill, manufactured by Turbo Kogyo Co., Ltd., and a method in which toner base particles are pressed against the inner wall of a casing by centrifugal force by means of a high-speed rotating blade to apply mechanical impact force to the toner base particles by force such as compression force or frictional force, as exemplified by apparatus such as a mechanofusion system manufactured by Hosokawa Micron Corporation or a hybridization system manufactured by Nara Machinery Co., Ltd.

When the mechanical impact force is used, thermomechanical impact where heat is applied at a temperature around glass transition temperature (Tg) of the magnetic toner (Tg±10° C.) as treatment temperature is preferred from the viewpoint of prevention of agglomeration and productivity. More preferably the treatment may be carried out at a temperature within±5° C. of the glass transition temperature (Tg) of the magnetic toner, as being effective for the improvement of transfer efficiency.

As the binder resin used when the toner base particles of the magnetic toner according to the present invention are produced by pulverization, it may include homopolymers of styrene or derivatives thereof, such as polystyrene and polyvinyl toluene; styrene copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-maleic acid copolymer and a styrene-maleate copolymer; and polymethyl methacrylate, polybutyl methacrylate, polyvinyl acetate, polyethylene, polypropylene, polyvinyl butyral, silicone resins, polyester resins, polyamide resins, epoxy resins and polyacrylic acid resins. Any of these may be used alone or in combination. In particular, styrene copolymers and polyester resins are preferred in view of developing performance and fixing performance.

The magnetic toner of the present invention may be produced by pulverization as described previously. However, the toner base particles obtained by such pulverization commonly have an amorphous shape, and hence any mechanical and thermal or any special treatment must be made in order to attain the physical properties, the average circularity of 0.960 or more, preferably used in the present invention. Thus, the productivity is lowered. Accordingly, in the magnetic toner of the present invention, it is preferable to produce toner base particles in a wet-process medium, e.g., by dispersion polymerization, association agglomeration or suspension polymerization. In particular, suspension polymerization is very preferable because the preferred physical properties in the present invention can be satisfied with-ease.

The suspension polymerization is a process in which a polymerizable monomer and a magnetic material (colorant), and also optionally a polymerization initiator, a cross-linking agent, a release agent, a charge control agent and other additives (e.g., a plasticizer and a high polymer) are uniformly dissolved or dispersed to prepare a polymerizable monomer composition, and thereafter this polymerizable monomer composition is dropwise added to a continuous phase (e.g., an aqueous phase) containing a dispersion stabilizer to carry out dispersion using a suitable dispersion machine and simultaneously carry out polymerization reaction to obtain toner base particles having the desired particle diameter. After granulation, agitation may be carried out using a usual agitator in such an extent that the state of particles is maintained and also the particles can be prevented from floating and settling. In the magnetic toner obtained by this suspension polymerization (hereinafter also referred to as "polymerization toner"), the individual toner base particles are uniform in a substantially spherical shape, and hence the magnetic toner satisfying the requirements for the physical properties, the average circularity of 0.960 or more and the mode circularity of 0.99 or more, which are preferable for the present invention, can be obtained with ease. Moreover, such a magnetic toner can also have a relatively uniform charge quantity distribution, and can be expected to be improved in image quality.

As the above dispersion machine, usable are dispersion machines such as a homogenizer, a ball mill, a colloid mill and an ultrasonic dispersion machine. Here, a high-speed dispersion machine such as a high-speed stirrer or an ultrasonic dispersion machine can be used to impart the desired particle size to the toner base particles at a stretch, whereby the resultant toner base particles more easily comes to have a sharp particle size distribution.

As for the time at which the polymerization initiator is added, it may be added simultaneously with the addition of other additives to the polymerizable monomer, or may be mixed immediately before they are suspended in the aqueous medium. Also, a polymerization initiator having been dissolved in the polymerizable monomer or in a solvent may be added before the polymerization is initiated.

In the production of the polymerization toner according to the present invention, the polymerizable monomer in the polymerizable monomer composition may include the following.

The polymerizable monomer may include styrene; styrene monomers such as o-methylstyrene, m-methylstyrene, p-methylstyrene, p-methoxystyrene and p-ethylstyrene; acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and other monomers such as acrylonitrile, methacrylonitrile and acrylamides. Any of these monomers may be used alone or in the form of a mixture thereof. Of the foregoing monomers, styrene or a styrene derivative may preferably be used alone or in the form of a mixture with other monomers, in view of developing performance and running (extensive operation) performance of the toner.

In the production of the polymerization toner according to the present invention, the polymerization may be carried out by adding a resin in the polymerizable monomer composition. For example, a polymerizable monomer component containing a hydrophilic functional group such as an amino group, a carboxylic group, a hydroxyl group, a sulfonic acid group, a glycidyl group or a nitrile group can not be used because it is water-soluble as a monomer, and hence dissolves in an aqueous suspension to cause emulsion polymerization. When such a monomer component should be introduced into toner base particles, it may be used in the form of a copolymer such as a random copolymer, a block copolymer or a graft copolymer, with a vinyl compound such as styrene or ethylene, in the form of a polycondensation product such as polyester or polyamide, or in the form of a polyaddition product such as polyether or polyimine. Where the high polymer containing such a polar functional group is incorporated in the toner base particles, it is localized on toner particle surfaces, and hence a toner having good anti-blocking properties and developing performance can be obtained.

Of these resins, the incorporation of a polyester resin can be especially greatly effective. This is presumed to be for the following reason. The polyester resin contains many ester linkages, which have a relatively high polarity, and hence the resin itself has a high polarity. On account of this high polarity, a strong tendency for the polyester to localize on droplet surfaces of the polymerizable monomer composition is shown in the aqueous dispersion medium, and the polymerization proceeds in that state until toner base particles are formed. Hence, the polyester resin localizes on toner base particle surfaces to provide the toner base particles with a uniform surface state and surface composition, so that the toner can have a uniform charging performance and also, since the release agent can be suitably enclosed in toner base particles, can enjoy very good developing performance in virtue of a synergistic effect of the two.

As the polyester resin used in the present invention, a saturated polyester resin or an unsaturated polyester resin, or both of them, may be used under appropriate selection in order to control performances of the toner, such as charging performance, running performance and fixing performance.

As the polyester resin used in the present invention, conventional ones may be used which are constituted of an alcohol component and an acid component. The components are as exemplified below.

As the alcohol component, it may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexane dimethanol, butenediol, octenediol, cyclohexene dimethanol, hydrogenated bisphenol A, a bisphenol derivative represented by the following Formula (I):

(I)

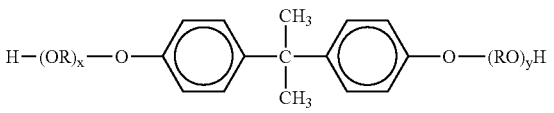

wherein R represents an ethylene group or a propylene group, x and y are each an integer of 1 or more, and an average value of x+y is 2 to 10; or a hydrogenated compound of Formula (I), and a diol represented by the following Formula (II):

(II)

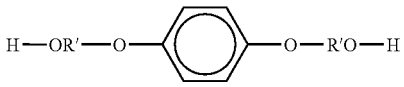

wherein R' represents —$CH_2CH_2$—,

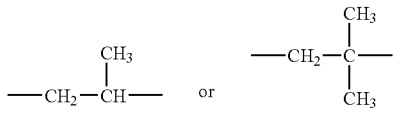

or a hydrogenated diol of the compound of Formula (II).

As a dibasic carboxylic acid, it may include benzene dicarboxylic acids or anhydrides thereof, such as phthalic acid, terephthalic acid, isophthalic acid and phthalic anhydride; alkyldicarboxylic acids such as succinic acid, adipic acid, sebacic acid and azelaic acid, or anhydrides thereof, or succinic acid or its anhydride substituted with a lower alkyl or alkenyl group having 6 to 18 carbon atoms; and unsaturated dicarboxylic acids such as fumaric acid, maleic acid, citraconic acid and itaconic acid, or anhydrides thereof.

The alcohol component may further include polyhydric alcohols such as glycerol, pentaerythritol, sorbitol, and oxyakylene ethers of novolak phenol resins. The acid component may include polycarboxylic acids such as trimellitic acid, pyromellitic acid, 1,2,3,4-butanetetracarboxylic acid, benzophenonetetracarboxylic acid and anhydrides thereof.

Of the above polyester resins, preferably used is an alkylene oxide addition product of the above bisphenol A, which has superior chargeability and environmental stability and is suitably balanced in other electrophotographic performances. In the case of this compound, the alkylene oxide may preferably have an average addition molar number of from 2 to 10 in view of fixing performance and running performance of the toner.

The polyester resin in the present invention may preferably be composed of 45 to 55 mol % of the alcohol component and 55 to 45 mol % of the acid component in the whole components.

The polyester resin may preferably have an acid value of from 0.1 to 50 mg.KOH/1 g of resin, in order for the resin to be present at toner particle surfaces in the magnetic toner of the present invention and in order for the resultant toner particles to exhibit stable charging performance. If the acid value is less than 0.1 mg.KOH/1 g of resin, it tends to be present at the toner particle surfaces in an absolutely insufficient quantity. If the acid value is more than 50 mg.KOH/1 g of resin, it tends to adversely affect the charging performance of toner. In the present invention, it is more preferable that the acid value is in the range of from 5 to 35 mg.KOH/1 g of resin.

In the present invention, as long as physical properties of the toner particles obtained are not adversely affected, it is also preferable to use two or more types of polyester resins in combination or to regulate physical properties of the polyester resin by modifying it with, e.g., silicone or a fluoroalkyl-group-containing compound.

In the case where a high polymer containing such a polar functional group is used, one having a number-average molecular weight of 5,000 or more may preferably be used. The high polymer having a number-average molecular weight of less than 5,000, especially 4,000 or less, are not preferable because the polymer is apt to concentrate in the vicinity of toner particles surfaces to lower the developing performance, anti-blocking properties and running performance. Also, the ratio of weight-average molecular weight to number-average molecular weight (Mw/Mn) may preferably be from 1.2 to 10.0 from the viewpoint of fixing performance and anti-blocking properties. In addition, the number-average molecular weight and the weight-average molecular weight may be measured by the GPC described previously.

For the purpose of improving dispersibility of materials, fixing performance or image characteristics, resins other than the foregoing may also be added to the monomer composition. The resins usable therefor may include homopolymers of styrene and derivatives thereof, such as polystyrene and polyvinyl toluene; styrene copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-maleic acid copolymer and a styrene-maleate copolymer; and polymethyl methacrylate, polybutyl methacrylate, polyvinyl acetate, polyethylene, polypropylene, polyvinyl butyral, silicone resins, polyester resins, polyamide resins, epoxy resins, polyacrylic acid resins, rosins, modified rosins, terpene resins, phenolic resins, aliphatic or alicyclic hydrocarbon resins, and aromatic petroleum resins, any of which may be used alone or in the form of a mixture. Any of these may preferably be added in an amount of from 1 to 20 parts by weight based on 100 parts by weight of the polymerizable monomer. When added in an amount of less than 1 part by weight, the effect of its addition is not sufficiently exhibited. On the other hand, when added in an amount of more than 20 part by weight, it difficult to design various physical properties of the polymerization toner.

As the polymerization initiator used in the production of the magnetic toner by polymerization, a polymerization initiator is preferred having a half-life of from 0.5 to 30 hours at temperature at which polymerization is carried out. Such a polymerization initiator may be added in an amount of from 0.5 to 20 parts by weight based on 100 parts by weight of the polymerizable monomer. Polymerization reaction carried out under such conditions enables a polymer having a maximum value in the region of molecular weight of from 10,000 to 100,000 to be produced, and enables the toner to be endowed with the desired strength and appropriate melt characteristics.

The polymerization initiator may include azo type or diazo type polymerization initiators such as 2,2'-azobis-(2,4-dimethylvaleronitrile), 2,2'-azobisisobutyronitrile, 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, t-butyl peroxy-2-ethylhexanoate and t-butyl peroxypivarate.

When the toner base particles of the magnetic toner of the present invention is produced by polymerization, a cross-linking agent may be added preferably in an amount of from 0.001 to 15% by weight based on based on 100 parts by weight of the polymerizable monomer.

Here, as the cross-linking agent, compounds having at least two polymerizable double bonds is primarily used. It may include, e.g., aromatic divinyl compounds such as divinyl benzene and divinyl naphthalene; carboxylic acid esters having two double bonds, such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these may be used alone or in the form of a mixture.

In the case where the toner base particles are produced by polymerization, any known surface-active agents or organic dispersants or inorganic dispersants may be used. In particular, the inorganic dispersants may hardly cause any harmful ultrafine powder and attain dispersion stability on account of their steric hindrance. Hence, even when reaction temperature is changed, they may hardly loose the stability, can be washed with ease and may hardly adversely affect toners, and hence they may preferably be used. As examples of such inorganic dispersants, they may include phosphoric acid polyvalent metal salts such as tricalcium phosphate, magnesium phosphate, aluminum phosphate, zinc phosphate and hyroxyapatite; carbonates such as calcium carbonate and magnesium carbonate; inorganic salts such as calcium metasilicate, calcium sulfate and barium sulfate; and inorganic oxides such as calcium hydroxide, magnesium hydroxide and aluminum hydroxide.

Any of these inorganic dispersants may preferably be used in an amount of from 0.2 to 20 parts by weight based on 100 parts by weight of the polymerizable monomer. The inorganic dispersants may each be used alone or be used in combination. A surface-active agent may further be used along with the dispersant in an amount of from 0.001 to 0.1 part by weight.

When these inorganic dispersants are used, they may be used as they are. In order to obtain finer particles, particles of the inorganic dispersant may be formed in the aqueous medium when used. For example, in the case of tricalcium phosphate, a sodium phosphate aqueous solution and a calcium chloride aqueous solution may be mixed under high-speed agitation, whereby water-insoluble calcium phosphate can be formed and more uniform and finer dispersion can be made. Here, water-soluble sodium chloride is simultaneously formed as a by-product. However, the presence of such a water-soluble salt in the aqueous medium keeps the polymerizable monomer from being dissolved in water, so that ultrafine toner particles is hardly formed by emulsion polymerization, and hence this is more favorable.

Such a surface-active agent may include, e.g., sodium dodecylbenzenesulfate, sodium tetradecyl sulfate, sodium pentadecyl sulfate, sodium octyl sulfate, sodium oleate, sodium laurate, sodium stearate and potassium stearate.

In the step of polymerization, the polymerization may be carried out at a polymerization temperature set at 40° C. or above, and commonly at a temperature of from 50° C. to 90° C. Where the polymerization is carried out in this temperature range, the release agent to be enclosed in particles becomes deposited by phase separation and more perfectly enclosed in particles. In order to exhaust residual polymerizable monomers, the reaction temperature may be raised to 90° C. to 150° C. at the end of polymerization reaction.

The polymerization toner base particles are, after the polymerization is completed, may be filtered, washed and dried by conventional methods, and external additives may optionally be mixed so as to be deposited on the particle surfaces, thus the magnetic toner of the present invention can be obtained. Also, the step of classification may also be added to the production process to remove any coarse powder and fine powder. In addition, as described previously, the toner base particles may be used as the toner as they are. External additives may be added to the toner base particles, and the resulting particles may be used as the toner.

In the present invention, in either of a case in which the toner base particles are produced by pulverization or a case in which they are produced by polymerization, it is preferable that an inorganic fine powder having a number-average primary particle diameter of from 4 nm to 80 nm, and more preferably from 6 nm to 40 nm, is added as an external additive. The inorganic fine powder is added in order to improve the fluidity of the magnetic toner and make the charging of the magnetic toner particles uniform, where the inorganic fine powder may be subjected to treatment, e.g., hydrophobic treatment, so that the toner can be endowed with the function to regulate its charge quantity and improve its environmental stability.

If the inorganic fine powder has a number-average primary particle diameter of more than 80 nm or the inorganic fine powder of 80 nm or less in diameter is not added, no good fluidity of the magnetic toner may be achieved, so that the toner particles tend to be non-uniformly charged to inevitably cause problems of fogging, a decrease in image density and an increase in toner consumption. If on the other hand the inorganic fine powder has a number-average primary particle diameter of less than 4 nm, the inorganic fine powder may be highly susceptible to agglomerate, and tends to behave not as primary particles but as agglomerates having a broad particle size distribution which are so strongly agglomerative as to be difficult to break up even by disintegration treatment, so that the agglomerates may be involved in development or may scratch the image-bearing member or toner-carrying member to cause image defects, which is undesirable.

In the present invention, the measurement of the number-average primary particle diameter of the inorganic fine powder may be carried out in the following way. In a photograph of toner particles taken under magnification with a scanning electron microscope, while comparing it with a photograph of toner particles mapped with elements contained in the inorganic fine powder by means of an elemental analysis means such as XMA (X-ray microanalyzer) attached to the scanning electron microscope, at least 100 primary particles of the inorganic fine powder which are present in the state they adhere to or are liberated from toner particle surfaces are observed to measure their number-based average primary particle diameter to determine the number-average primary particle diameter.

As the inorganic fine powder used in the present invention, fine silica powder, fine titanium oxide powder, fine alumina powder or the like may be used.

As the fine silica powder, usable are, e.g., the so called dry-process silica or fumed silica produced by vapor phase oxidation of silicon halides and the so called wet-process silica produced from water glass or the like, either of which may be used. The dry-process silica is preferred, as having less silanol groups on the particle surfaces and interiors of the fine silica powder and leaving less production residues such as $Na_2O$ and $SO_3^{2-}$. In the dry-process silica, it is also possible to use, e.g., in its production step, other metal halide such as aluminum chloride or titanium chloride together with the silicon halide to give a composite fine powder of silica with other metal oxide. The fine silica powder includes these as well.

The inorganic fine powder having a number-average primary particle diameter of from 4 nm to 80 nm may preferably be added in an amount of from 0.1 to 3.0% by weight based on the weight of the toner base particles. When added in an amount of less than 0.1% by weight, the effect of its addition is insufficiently exhibited. When added in an amount of more than 3.0% by weight, the fixing performance of the toner is lowered.

The content of the inorganic fine powder may be determined by fluorescent X-ray analysis and using a calibration curve prepared from a standard sample.

In the present invention, from the viewpoint of improving environmental stability, the inorganic fine powder may preferably be a powder having been subjected to hydrophobic treatment. Where the inorganic fine powder added to the magnetic toner has moistened, the magnetic toner may be charged in a very low quantity to tend to have non-uniform charge quantity and to cause toner scatter.

As a treating agent used for such hydrophobic treatment, usable are a silicone varnish, a modified silicone varnish of various types, a silicone oil, a modified silicone oil of various types, a silane compound, a silane coupling agent, other organic silicon compound and an organotitanium compound, any of which may be used alone or in combination.

In particular, the inorganic fine powder having been treated with a silicone oil are preferred. It is more preferable that the inorganic fine powder has been subjected to hydrophobic treatment with a silane compound and, simultaneously with or after the treatment, treatment with a silicone oil, in order to maintain the charge quantity of the magnetic toner at a high level even in a high humidity environment and to prevent toner scatter.

As a method for such treatment of the inorganic fine powder, for example, the inorganic fine powder may be treated, as first-stage reaction, with the silane compound to effect silylation reaction to cause silanol groups to disappear by chemical coupling, and thereafter, as second-stage reaction, with the silicone oil to form hydrophobic thin films on particle surfaces.

The silicone oil may preferably be one having a viscosity at 25° C. of from 10 to 200,000 $mm^2/s$, and more preferably from 3,000 to 80,000 $mm^2/s$. If the viscosity is less than 10 $mm^2/s$, the inorganic fine powder may have no stability, and the image quality tends to lower because of thermal and mechanical stress. If the viscosity is more than 200,000 $mm^2/s$, uniform treatment is hard to carry out.

As the silicone oil used, particularly preferred are, e.g., dimethylsilicone oil, methylphenylsilicone oil, α-methylstyrene modified silicone oil, chlorophenylsilicone oil and fluorine modified silicone oil.

As a method for treating the inorganic fine powder with the silicone oil, for example, the inorganic fine powder having been treated with a silane compound and the silicone oil may directly be mixed by means of a mixer such as Henschel mixer, or the silicone oil may be sprayed on the inorganic fine powder. Alternatively, a method may be used in which the silicone oil is dissolved or dispersed in a suitable solvent and thereafter the inorganic fine powder is added thereto and mixed, followed by removing the solvent. In view of such an advantage that agglomerates of the inorganic fine powder can be reduced, the method making use of a sprayer is preferred.

The silicone oil may be used for the treatment in an amount of from 1 to 40 parts by weight, and preferably from 3 t 35 parts by weight, based on 100 parts by weight of the inorganic fine powder. If the silicone oil is in a too small quantity, the inorganic fine powder can not be made sufficiently hydrophobic. If it is in a too large quantity, problems such as fogging tend to occur.

In order to endow the magnetic toner with a good fluidity, the inorganic fine powder used in the present invention may preferably be one having a specific surface area ranging from 20 to 350 $m^2/g$, and more preferably from 25 to 300 $m^2/g$, in measurement by the BET method utilizing nitrogen adsorption.

The specific surface area is measured according to the BET method, where nitrogen gas is adsorbed onto sample surfaces using a specific surface area measuring device AUTOSOBE 1 (manufactured by Yuasa Ionics Co.), and the specific surface area is calculated by the BET multiple point method.

In order to improve cleaning performance and so forth, inorganic or organic closely spherical fine particles having a primary particle diameter of more than 30 nm (preferably having a BET specific surface area of less than 50 $m^2/g$), and more preferably a primary particle diameter of more than 50 nm (preferably having a BET specific surface area of less than 30 $m^2/g$), may further be added to the magnetic toner of the present invention. This is also one of preferred embodiments. For example, spherical silica particles, spherical polymethyl silsesquioxane particles and spherical resin particles may preferably be used.

In the magnetic toner of the present invention, other additives may further be used as long as their addition substantially does not adversely affect the magnetic toner, which may include, e.g., lubricant powders such as polyethylene fluoride powder, zinc stearate powder and polyvinylidene fluoride powder; abrasives such as cerium oxide powder, silicon carbide powder and strontium titanate powder; fluidity-providing agents such as titanium oxide powder and aluminum oxide powder; and anti-caking agents; as well as reverse-polarity organic particles and inorganic particles which may also be used in a small quantity as a developability improver. These additives may also be used after hydrophobic treatment of their particle surfaces.

An example of an image forming apparatus in which the magnetic toner of the present invention is preferably usable is specifically described below with reference to FIG. 2.

Figure 2:
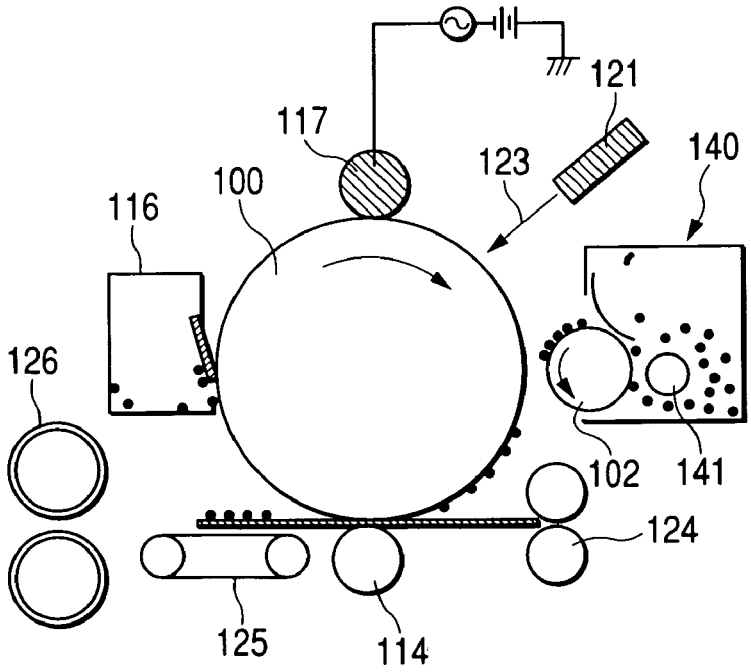
FIG. 2 is a view showing an example of an image forming apparatus used in Examples of the present invention.

In FIG. 2, reference numeral 100 denotes an image bearing member photosensitive member, around which a primary charging roller 117, a developing assembly 140, a transfer charging roller 114 and a cleaner 116 are provided. Then, the photosensitive member 100 is electrostatically charged to −600 V by means of the primary charging roller 117, to which, e.g., an AC voltage of 2.0 kV (Vpp) and a DC voltage of −620 V (Vdc) are kept applied. Next, the photosensitive member 100 is exposed by irradiating it with laser light 123 by means of a laser generator 121. An electrostatic latent image formed on the photosensitive member 100 is developed with a one-component magnetic toner by means of the developing assembly 140 to form a toner image, which is then transferred to a transfer material by means of the transfer roller 114 brought into contact with the photosensitive member via the transfer material. The transfer material holding the toner image thereon is transported to a fixing assembly 126 by a transport belt 125, and the toner image is fixed onto the transfer material. Also, the toner left partly on the photosensitive member is removed by the cleaner 116 (cleaning means) to clean the surface. In addition, reference numeral 124 denotes a registration roller.

Figure 3:
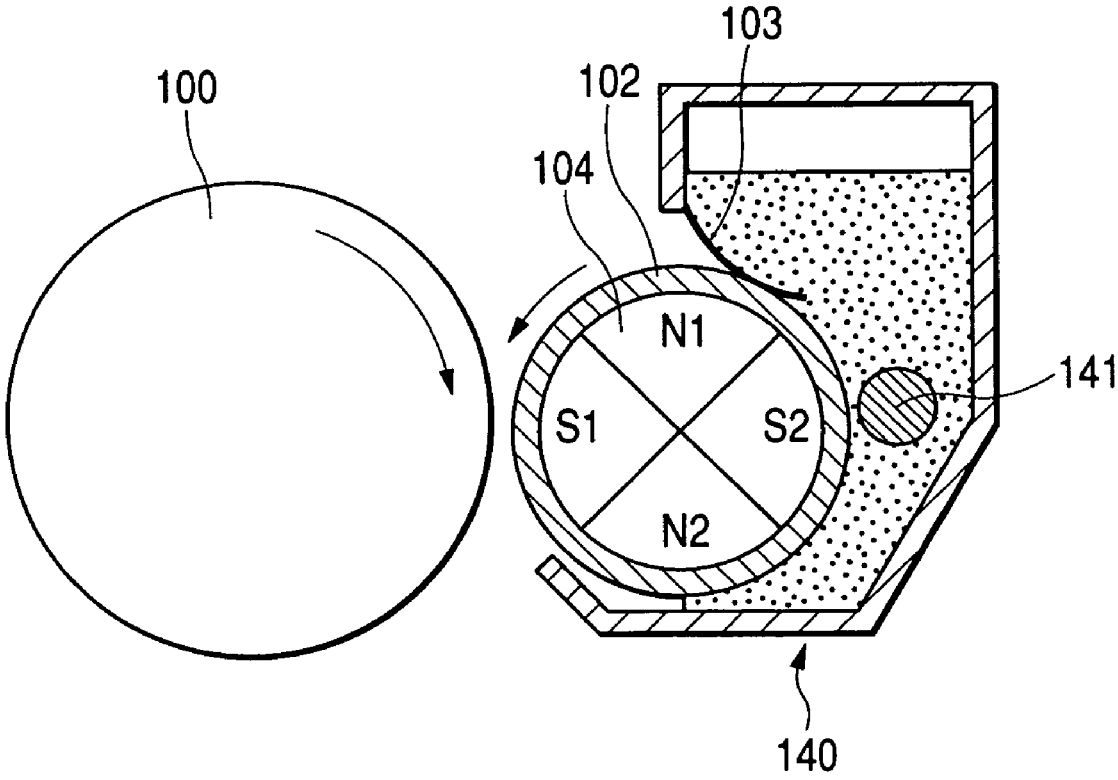
FIG. 3 is an enlarged view of a developing section.

In the developing assembly 140, as shown in FIG. 3, a cylindrical toner carrying member (hereinafter "developing sleeve") 102 made of a non-magnetic metal such as aluminum or stainless steel is provided in proximity to the photosensitive member 100. A gap between the photosensitive member 100 and the developing sleeve 102 is maintained to, e.g., about 280 μm by the aid of a sleeve-to-photosensitive member gap retaining member (not shown). In the interior of the developing sleeve 102, a magnet roller 104 is so set as to be concentric to the developing sleeve 102. However, the developing sleeve 102 can be rotated. The magnet roller 104 has a plurality of magnetic poles as shown in FIG. 3, where S1 is involved in development; N1, control of toner coat level; S2, take-in and transport of the toner; and N2, prevention of the toner from escaping. As a member which controls the quantity of the magnetic toner transported adhering to the developing sleeve 102, an elastic blade 103 (toner layer thickness control member) is provided in touch with the developing sleeve 102. In the developing zone, DC and AC developing biases are applied across the photosensitive member 100 and the developing sleeve 102. The toner on the developing sleeve 102 is attracted onto the photosensitive member 100 in accordance with the electrostatic latent image to form a visible image.

EXAMPLES

The present invention is described below in greater detail by giving production examples and working examples, which should not be construed to limit the present invention. In the following formulation, "part(s)" refers to "part(s) by weight" in all occurrences.

Production of Crystalline Polyester

Into a reactor having a stirrer, a thermometer and a condenser for flow-out, 118.1 parts (1.0 mol), 94.6 parts (1.05 mols) of 1,4-butanediol and 0.50 parts of tetrabutyl titanate were introduced to carry out esterification reaction at 190° C. Thereafter, the temperature was raised to 220° C. and at the same time the interior of the system was gradually evacuated, where polycondensation reaction was carried out at 150 Pa to obtain a crystalline polyester. The crystalline polyester had an endothermic peak top temperature of 112° C., a number-average molecular weight of 4,000, a weight-average molecular weight of 6,000 and an acid value of 0.4 mg.KOH/g. The crystalline polyester obtained was crushed and thereafter finely pulverized to have a volume average particle diameter of 28 μm.

Production of Magnetic Material 1

In a ferrous sulfate aqueous solution, 1.0 to 1.1 equivalent weight of a sodium hydroxide solution, based on iron element, 1.5% by weight of sodium hexametaphosphate in terms of phosphorus element, based on iron element, and 1.5% by weight of sodium silicate in terms of silicon element, based on iron element, were mixed to prepare an aqueous solution containing ferrous hydroxide.

While keeping this aqueous solution to pH 9, air was blown into the solution, and oxidation reaction was carried out at 80° C. to 90° C. to prepare a slurry from which seed crystals were to be formed.

Next, to this slurry, a ferrous sulfate aqueous solution was so added as to be from 0.9 to 1.2 equivalent weight based on the initial alkali quantity (sodium component of sodium hydroxide). Thereafter, while keeping the slurry to pH 8, air was blown into the slurry, during which the oxidation reaction was allowed to proceed, obtaining a slurry containing magnetic iron oxide. This slurry was filtered and washed and thereafter this water-containing slurry was taken out once. At this point, this water-containing sample was collected in a small quantity to measure its water content previously. Then, without being dried, this water-containing sample was re-dispersed in a different aqueous medium. Thereafter, the pH of the liquid re-dispersion was adjusted to about 4.5, and, with thorough stirring, n-hexyltrimethoxysilane was added thereto in an amount of 2.0 parts (the quantity of the magnetic iron oxide was calculated as the value found by subtracting the water content from the water-containing sample) based on 100 parts by weight of the magnetic iron oxide, to carry out hydrolysis. Thereafter, the pH of the liquid dispersion was adjusted to about 10, where condensation reaction was carried out and coupling treatment was carried out. The hydrophobic magnetic fine particles thus formed were washed, filtered and dried by conventional methods, and the resultant particles were subjected to disintegration treatment. The magnetic fine particles thus obtained had a volume-average particle diameter of 0.20 μm and a tap density of 1.87 g/cm$^3$.

To 100 parts of the magnetic fine particles thus obtained, 7 parts of polyethylene wax (volume-average particle diameter=52 μm, Mn=650) was added as the low-softening substance (A) to carry out treatment for 2 hours by means of an edge runner mill at a linear pressure of 45 kg/cm while cooling the interior of the system to a temperature of 60° C. or below, obtaining spherical Magnetic Material 1 having a volume-average particle diameter of 0.23 μm. The volume-average particle diameter of the magnetic fine particles after treatment increased by 0.03 μm with respect to that of the magnetic fine particles before treatment. From this fact, it is considered that the surfaces of magnetic fine particles was substantially desirably treated with the low-softening substance (A) added. Physical properties of Magnetic Material 1 obtained are shown in Table 1.

Production of Magnetic Material 2

In an aqueous ferrous sulfate solution, 1.0 to 1.1 equivalent weight of a sodium hydroxide solution, based on iron element, 1.5% by weight of sodium hexametaphosphate in terms of phosphorus element, based on iron element, and 1.5% by weight of sodium silicate in terms of silicon element, based on iron element, were mixed to prepare an aqueous solution containing ferrous hydroxide.

While keeping this aqueous solution to pH 9, air was blown into it, and oxidation reaction was carried out at 80° C. to 90° C. to prepare a slurry from which seed crystals were to be formed.

Next, to this slurry, an aqueous ferrous sulfate solution was so added as to be from 0.9 to 1.2 equivalent weight based on the initial alkali quantity (sodium component of sodium hydroxide). Thereafter, while the slurry was kept to pH 8, air was blown into the slurry, during which the oxidation reaction was allowed to proceed, obtaining a slurry containing magnetic iron oxide. This slurry was filtered, washed and dried, followed by disintegration treatment. To the resultant product, 2.0 parts of n-octyltriethoxysilane was added to carry out treatment for 60 minutes by means of an edge runner mill, thus the surfaces of magnetic fine particles were subjected to hydrophobic treatment. The magnetic fine particles obtained had a volume-average particle diameter of 0.20 μm and a tap density of 1.87 g/cm$^3$.

To 100 parts of the magnetic fine particles thus obtained, 5 parts of Fischer-Tropsch wax (volume-average particle diameter=34 μm, Mn=750) was added as the low-softening substance (A) to carry out treatment by means of an edge runner mill under the same conditions as in the production of Magnetic Material 1, obtaining spherical Magnetic Material 2 having a volume-average particle diameter of 0.22 μm. Physical properties of Magnetic Material 2 obtained are shown in Table 1.

Production of Magnetic Material 3

Magnetic Material 3 was obtained in the same manner as in Production of Magnetic Material 2 except that, in place of the Fischer-Tropsch wax, the crystalline polyester produced as described above (volume average particle diameter: 28 μm) was used as the low-softening substance (A). Physical properties of Magnetic Material 3 obtained are shown in Table 1.

Production of Magnetic Material 4

Magnetic Material 4 was obtained in the same manner as in Production of Magnetic Material 2 except that the Fischer-Tropsch wax was replaced with polypropylene wax (volume-average particle diameter=138 μm, Mn=960). Physical properties of Magnetic Material 4 obtained are shown in Table 1.

Production of Magnetic Material 5

Magnetic Material 5 was obtained in the same manner as in Production of Magnetic Material 2 except that the Fischer-Tropsch wax was replaced with paraffin wax (volume-average particle diameter=57 μm, Mn=430). Physical properties of Magnetic Material 5 obtained are shown in Table 1.

Production of Magnetic Material 6

Magnetic Material 6 was obtained in the same manner as in Production of Magnetic Material 2 except that the Fischer-Tropsch wax was used in an amount of 0.2 part instead of 5 parts. Physical properties of Magnetic Material 6 obtained are shown in Table 1.

Production of Magnetic Material 7

Magnetic Material 7 was obtained in the same manner as in Production of Magnetic Material 2 except that the Fischer-Tropsch wax was used in an amount of 16 parts instead of 5 parts. Physical properties of Magnetic Material 7 obtained are shown in Table 1.

Production of Magnetic Material 8

Magnetic Material 8 was obtained in the same manner as in Production of Magnetic Material 2 except that the treatment with the n-octyltriethoxysilane was not carried out. Physical properties of Magnetic Material 8 obtained are shown in Table 1.

Production of Magnetic Material 9

Magnetic Material 9 was obtained in the same manner as in Production of Magnetic Material 2 except that the Fischer-Tropsch wax was replaced with one having a volume-average particle diameter of 534 μm. Physical properties of Magnetic Material 9 obtained are shown in Table 1.

Production of Magnetic Material 10

Magnetic Material 10 was obtained in the same manner as in Production of Magnetic Material 2 except that the Fischer-Tropsch wax was replaced with one having a volume-average particle diameter of 1.1 mm. Physical properties of Magnetic Material 10 obtained are shown in Table 1.

Production of Magnetic Material 11

Magnetic Material 11 was obtained in the same manner as in Production of Magnetic Material 2 except that the time taken for the treatment carried out by using the edge runner mill was changed to 4 hours. Physical properties of Magnetic Material 11 obtained are shown in Table 1.

Production of Magnetic Material 12

Magnetic Material 12 was obtained in the same manner as in Production of Magnetic Material 2 except that the time taken for the treatment carried out using the edge runner mill was changed to 6 hours. Physical properties of Magnetic Material 12 obtained are shown in Table 1.

Production of Magnetic Material 13

Magnetic Material 13 was obtained in the same manner as in Production of Magnetic Material 2 except that the time taken for the treatment carried out using the edge runner mill was changed to 10 minutes. Physical properties of Magnetic Material 13 obtained are shown in Table 1.

Production of Magnetic Material 14

Magnetic Material 14 was obtained in the same manner as in Production of Magnetic Material 2 except that the edge runner mill was not used and 100 parts of the magnetic fine particles treated with the coupling agent and 5 parts of the Fischer-Tropsch wax were mixed for 30 minutes by means of Henschel mixer at an agitation blade peripheral speed of 50 m/sec. Physical properties of Magnetic Material 14 obtained are shown in Table 1.

Production of Magnetic Material 15

The surfaces of magnetic fine particles were subjected to hydrophobic treatment with n-octyltriethoxysilane in the same manner as Magnetic Material 2.

In 50 parts of toluene, 5 parts of Fischer-Tropsch wax was dissolved with heating, and the resultant toluene solution of wax was dropwise added, with vigorous stirring, to 100 parts of the magnetic fine particles treated with the coupling agent. Then, the slurry formed was gradually heated to distil away the toluene completely, obtaining Magnetic Material 15 having a volume-average particle diameter of 0.21 μm. Physical properties of Magnetic Material 15 obtained are shown in Table 1.

Production of Magnetic Material 16

Oxidation reaction was allowed to proceed in the same manner as in Production of Magnetic Material 2. This slurry was filtered, washed and dried, followed by sufficient disintegration treatment to produce Magnetic Material 16. Physical properties of Magnetic Material 16 obtained are shown in Table 1.

TABLE 1

Physical Properties of Magnetic Material

| Magnetic Material: | Low-softening substance (A) used in treatment of magnetic fine particles: Type | Amt. (pbw) | Endothermic peak (° C.) | Av. particle diam. (μm) | *1 Saturation mag-netization (emu/g) | Apparent density (g/cm³) | Tap density (g/cm³) | *2 A = value | Compressibility | Liberation percentage (%) |
|---|---|---|---|---|---|---|---|---|---|---|
| 1 | Polyethylene | 7 | 108 | 0.23 | 63.6 | 1.01 | 1.83 | 0.98 | 45 | 2.6 |
| 2 | Fischer-Tropsch | 5 | 125 | 0.22 | 64.8 | 1.01 | 1.81 | 0.97 | 44 | 3.1 |
| 3 | Crystalline polyester | 5 | 112 | 0.22 | 64.7 | 1.00 | 1.82 | 0.97 | 45 | 2.9 |
| 4 | Polypropylene | 5 | 154 | 0.22 | 64.9 | 1.00 | 1.72 | 0.92 | 42 | 10.9 |
| 5 | Paraffin | 5 | 78 | 0.22 | 64.7 | 1.02 | 1.85 | 0.99 | 45 | 1.6 |
| 6 | Fischer-Tropsch | 0.2 | 125 | 0.20 | 67.9 | 1.01 | 1.84 | 0.98 | 45 | 0.2 |
| 7 | Fischer-Tropsch | 16 | 125 | 0.25 | 58.9 | 1.00 | 1.67 | 0.89 | 40 | 16.9 |
| 8 | Fischer-Tropsch | 5 | 125 | 0.22 | 64.7 | 0.99 | 1.63 | 0.87 | 39 | 17.6 |
| 9 | Fischer-Tropsch | 5 | 125 | 0.22 | 64.8 | 1.00 | 1.69 | 0.90 | 41 | 16.2 |
| 10 | Fischer-Tropsch | 5 | 125 | 0.21 | 64.7 | 0.99 | 1.62 | 0.87 | 39 | 26.1 |
| 11 | Fischer-Tropsch | 5 | 125 | 0.22 | 64.9 | 0.98 | 1.55 | 0.83 | 37 | 1.8 |
| 12 | Fischer-Tropsch | 5 | 125 | 0.22 | 64.7 | 0.96 | 1.46 | 0.78 | 34 | 0.7 |
| 13 | Fischer-Tropsch | 5 | 125 | 0.21 | 64.8 | 0.96 | 1.41 | 0.75 | 32 | 43.5 |

TABLE 1-continued

Physical Properties of Magnetic Material

| Magnetic Material: | Low-softening substance (A) used in treatment of magnetic fine particles Type | Amt. (pbw) | Endothermic peak (° C.) | Av. particle diam. (μm) | *1 Saturation mag-netization (emu/g) | Apparent density (g/cm³) | Tap density (g/cm³) | *2 A = value | Compressibility | Liberation percentage (%) |
|---|---|---|---|---|---|---|---|---|---|---|
| 14 | Fischer-Tropsch | 5 | 125 | 0.20 | 64.9 | 0.96 | 1.39 | 0.74 | 31 | 89.2 |
| 15 | Fischer-Tropsch | 5 | 125 | 0.22 | 64.8 | 0.97 | 1.43 | 0.76 | 32 | 0.1 |
| 16 | None | — | — | 0.20 | 68.0 | 1.01 | 1.87 | 1.00 | 46 | — |

*1: Saturation magnetization of the magnetic material is the value measured in an external magnetic field of 79.6 kA/m.
*2: A-value in Table 1 is the ratio of the tap density of magnetic material to the tap density of magnetic fine particles (tap density of magnetic material/tap density of magnetic fine particles).

Production of Magnetic Toner 1

In 720 parts by weight of ion-exchange water, 450 parts by weight of an aqueous 0.1 mol/liter $Na_3PO_4$ solution was introduced, followed by heating to 60° C. Thereafter, to the resultant mixture, 67.7 parts of a 1.0 mol/liter $CaCl_2$ aqueous solution was added to obtain an aqueous medium containing a dispersion stablizer.

| | |
|---|---|
| Styrene | 74 parts |
| n-Butyl acrylate | 26 parts |
| Divinylbenzene | 0.55 part |
| Saturated polyester resin (Mn: 11,000; Mw/Mn: 2.6; acid value: 12 mg · KOH/g; Tg: 72° C.) | 10 parts |
| Charge control agent (iron complex of azo dye T-77, available from Hodogaya Chemical Co., Ltd.) | 1 part |
| Magnetic Material 1 (containing 6.6 parts of polyethylene) | 101.6 parts |

Materials formulated as shown above were uniformly dispersed and mixed by means of an attritor (manufactured by Mitsui Miike Engineering Corporation). The mixture thus obtained was heated to 60° C., and 5 parts of an ester wax (maximum endothermic peak in DSC: 62° C.) was added thereto and mixed to dissolve. To the mixture obtained, 3 parts of a polymerization initiator 2,2'-azobis(2,4-dimethylvaleronitrile) was dissolved to prepare a polymerizable monomer composition.

The polymerizable monomer composition was introduced into the above aqueous medium, followed by stirring for 10 minutes at 60° C. in an atmosphere of $N_2$ by using a TK-type homomixer (manufactured by Tokushu Kika Kogyo Co., Ltd.) at 12,000 rpm to carry out granulation, and then, was allowed to react at 60° C. for 10 hours while being stirred with a paddle stirring blade. After the reaction was completed, the suspension formed was cooled, and hydrochloric acid was added thereto to dissolve the dispersion stabilizer, followed by filtration, water washing and then drying to produce Toner Base Particles 1.

100 parts of this Toner Base Particles 1 and 1.0 part of hydrophobic fine silica powder (one obtained by treating silica base particles of 12 nm in number-average primary particle diameter with hexamethyldisilazane and then with silicone oil and having a BET specific surface area of 120 $m^2/g$ after the treatment) were mixed by means of Henschel mixer (manufactured by Mitsui Miike Engineering Corporation) to produce Magnetic Toner 1 having a weight-average particle diameter of 6.8 μm. The toner obtained had a softening point Ts of 51.9° C., a THF-insoluble matter of 38% and a THF-insoluble matter peak top molecular weight of 19,000. Physical properties of Magnetic Toner 1 are shown in Table 2.

Production of Magnetic Toners 2 to 16

Magnetic Toners 2 to 16 were obtained in the same manner as in Production of Magnetic Toner 1 except that in place of Magnetic Material 1, Magnetic Materials 2 to 16 were used and their amounts were controlled. Physical properties of Magnetic Toners 2 to 16 are shown in Table 2. In addition, the amounts of the magnetic materials added were each so adjusted that the content in the toner of magnetic fine particles (containing a coupling agent and no low-softening substance) was 95 parts based on 100 parts by weight of the binder resin.

TABLE 2

Toner Physical Properties 1

| Magnetic toner | Weight = average particle diameter (μm) | Variation coefficient | Average circularity | Mode circularity | Softening point Ts (° C.) | THF-insoluble matter (wt. %) |
|---|---|---|---|---|---|---|
| 1 | 6.8 | 20 | 0.981 | 1.00 | 51.9 | 38 |
| 2 | 6.6 | 21 | 0.980 | 1.00 | 52.3 | 36 |
| 3 | 7.0 | 20 | 0.981 | 1.00 | 51.7 | 34 |
| 4 | 7.2 | 27 | 0.977 | 1.00 | 53.5 | 35 |
| 5 | 6.4 | 20 | 0.981 | 1.00 | 50.6 | 38 |
| 6 | 6.9 | 23 | 0.979 | 1.00 | 52.9 | 40 |
| 7 | 7.6 | 32 | 0.976 | 1.00 | 50.4 | 36 |

TABLE 2-continued

| Toner Physical Properties 1 | | | | | | |
|---|---|---|---|---|---|---|
| Magnetic toner | Weight = average particle diameter (μm) | Variation coefficient | Average circularity | Mode circularity | Softening point Ts (° C.) | THF-insoluble matter (wt. %) |
| 8 | 6.1 | 33 | 0.973 | 1.00 | 52.0 | 38 |
| 9 | 7.2 | 31 | 0.976 | 1.00 | 51.8 | 40 |
| 10 | 7.7 | 41 | 0.974 | 1.00 | 52.6 | 36 |
| 11 | 6.9 | 28 | 0.977 | 1.00 | 53.1 | 37 |
| 12 | 7.2 | 35 | 0.974 | 1.00 | 52.4 | 34 |
| 13 | 8.2 | 41 | 0.968 | 0.98 | 52.1 | 34 |
| 14 | 8.9 | 44 | 0.964 | 0.98 | 53.8 | 41 |
| 15 | 7.9 | 34 | 0.973 | 1.00 | 52.4 | 36 |
| 16 | 5.9 | 48 | 0.953 | 0.96 | 52.4 | 39 |

In addition, the magnetization intensity of each of the above magnetic toners under application of a magnetic field of 79.6 kA/m was within the range of from 29.5 to 30.5 $Am^2/kg$ in all the magnetic toners.

Example 1

Image Forming Apparatus:

As an image forming apparatus, LPB-1760 (a laser beam printer manufactured by CANON INC.) was modified so as to be used as the same one as shown in FIG. 2. As the charging member, a rubber roller charging assembly 117 with conductive carbon dispersed therein and covered with a nylon resin was brought into contact (contact pressure: 60 kg/cm) with the image bearing member (photosensitive member) 100, and a bias created by superimposing an AC voltage of 2.0 kVpp on a DC voltage of −620 V was applied to charge the surface of the photosensitive member uniformly. Subsequent to the charging, image areas were exposed to laser light 123 to form electrostatic latent images (dark-area potential Vd was −600 V, and light-area potential VL, −120 V).

The gap between the photosensitive member 100 and the developing sleeve 102 was set to be 280 μm. The developing sleeve 102 made of a surface-blasted aluminum cylinder of 16 mm in diameter on which a resin layer constituted as shown below and having a layer thickness of about 7 μm and a JIS center-line average roughness (Ra) of 1.0 μm was formed, was used as a magnetic-toner carrying member, having a developing magnetic pole of 95 mT (950 gausses). As the toner layer thickness control member 103, a blade made of urethane of 1.0 mm in thickness and 0.70 mm in free length was brought into touch with the developing sleeve 102 at a linear pressure of 39.2 N/m (40 g/cm).

| | |
|---|---|
| Phenol resin | 100 parts |
| Graphite (particle diameter: about 7 μm) | 90 parts |
| Carbon black | 10 parts |

As the development bias, used were a DC voltage Vdc of −420 V and an AC voltage of 1.6 kVpp and a frequency of 2,400 Hz as the alternating electric field to be superimposed thereon. Also, the peripheral speed of the developing sleeve was set to a speed of 110% (103 mm/sec) with respect to the peripheral speed of the photosensitive member (94 mm/sec).

Under such conditions, using Magnetic Toner 1, a 2,000-sheet image reproduction test was conducted in a normal-temperature and normal-humidity environment (23° C., 60% RH). A4-size 75 $g/m^2$ paper was used as recording mediums. As a result, at the initial stage and after 2,000-sheet running (extensive operation), no fog was seen in non-images areas, image density was 1.4 or more and highly minute images were obtained.

Solid images were formed on A4-size 75 $g/m^2$ paper so that the toner weight per unit area was 0.6 $mg/cm^2$, where the temperatures at which offset occurred at low temperature and high temperature were examined changing the temperature of the fixing assembly. As a result, Magnetic Toner 1 begun to be fixed from 130° C. (fixing start temperature) and did not cause any offset up to 240° C. on the high-temperature side (fixing maximum temperature or ending temperature), showing good fixing performance in a broad temperature range. The evaluation results are shown in Table 3.

Evaluation methods and evaluation criteria for evaluation items shown in Table 3 are described below.

Image Density:

Solid images were formed, and the image density of the solid images was measured with Macbeth reflection densitometer (manufactured by Macbeth Co.).

Fog:

White images were reproduced, and fog on paper was measured to make evaluation according to the following criteria. Here, fog was measured with REFLECTOMETER MODEL TC-6DS, manufactured by Tokyo Denshoku Co., Ltd. As a filter, a green filter was used, and fog was calculated according to the following expression.

Fog (%)=(reflectance (%) of reference paper)−(reflectance (%) of sample on which white images have been reproduced).

The fog was judged according to criteria shown below.

A: Very good (less than 1.5%).

B: Good (1.5% or more to less than 2.5%).

C: Average (2.5% or more to less than 4.0%).

D: Poor (4.0% or more).

Image Quality:

Image quality was evaluated in a comprehensive manner by halftone image uniformity and fine-line reproducibility as judgement criteria.

A: Sharp images having superior fine-line reproducibility and halftone image uniformity.

B: Good images, though having a little inferior fine-line reproducibility and halftone image uniformity.

C: Images on the level of no problem in practical use.

D: Undesirable images as having inferior fine-line reproducibility and halftone image uniformity.

Examples 2 to 11

Using Magnetic Toners 2 to 11, image reproduction tests and fixing tests were conducted in the same manner as in Example 1. As a result, all toners were able to form images beyond the level of no problem in practical use, and also showed good fixing performance in a broad temperature range. The evaluation results are shown in Table 3.

Comparative Examples 1 to 5

Using Magnetic Toners 12 to 16, image reproduction tests and fixing tests were conducted in the same manner as in Example 1.

As a result, in Comparative Examples 1 and 4 in which Magnetic Toners 12 and 15 were used, respectively, images having no problem in practical use were obtained, but the fixing start temperature was 160° C. or more, and the results showed that low-temperature fixing performance was inferior. In Comparative Examples 2 and 3 in which Magnetic Toners 13 and 14 were used, respectively, the toners showed inferior low-temperature fixing performance, and images as well were greatly inferior. In addition thereto, the toners caused melt adhesion to the toner carrying member. Also, in Comparative Example 5 in which Magnetic Toner 16 was used, the toners were inferior in low-temperature fixing performance, and images as well were greatly inferior. The evaluation results are shown in Table 3.

Production of Magnetic Toner 17

Magnetic Toner 17 was produced in the same manner as in Production of Magnetic Toner 1 except that the styrene and n-butyl acrylate used therein were used in amounts changed to 70 parts and 30 parts, respectively. Physical properties of Magnetic Toner 17 are shown in Table 4.

Production of Magnetic Toner 18

Magnetic Toner 18 was produced in the same manner as in Production of Magnetic Toner 1 except that the styrene and n-butyl acrylate used therein were used in amounts changed to 66 parts and 34 parts, respectively. Physical properties of Magnetic Toner 18 are shown in Table 4.

Production of Magnetic Toner 19

Magnetic Toner 19 was produced in the same manner as in Production of Magnetic Toner 1 except that the styrene and n-butyl acrylate used therein were used in amounts changed to 87 parts and 13 parts, respectively. Physical properties of Magnetic Toner 19 are shown in Table 4.

Production of Magnetic Toner 20

Magnetic Toner 20 was produced in the same manner as in Production of Magnetic Toner 1 except that the styrene and n-butyl acrylate used therein were used in amounts changed to 90 parts and 10 parts, respectively. Physical properties of Magnetic Toner 20 are shown in Table 4.

Production of Magnetic Toner 21

Magnetic Toner 21 was produced in the same manner as in Production of Magnetic Toner 1 except that the divinylbenzene used therein were used in an amount changed to 0.05 part. Physical properties of Magnetic Toner 21 are shown in Table 4.

Production of Magnetic Toner 22

Magnetic Toner 22 was produced in the same manner as in Production of Magnetic Toner 1 except that the divinylbenzene used therein were used in an amount changed to 0.20 part. Physical properties of Magnetic Toner 22 are shown in Table 4.

TABLE 3

| | | Test Results 1 | | | | | | | |
|---|---|---|---|---|---|---|---|---|---|
| | | Initial stage | | | After 2,000-sh. running | | | Fixing performance | |
| | Toner | Density | Fog | Image quality | Density | Fog | Image quality | Fixing start temp. | Fixing maximum temp. |
| Example: | | | | | | | | | |
| 1 | 1 | 1.52 | A | A | 1.51 | A | A | 130° C. | 240° C. |
| 2 | 2 | 1.51 | A | A | 1.50 | A | A | 130° C. | 240° C. |
| 3 | 3 | 1.52 | A | A | 1.51 | A | A | 125° C. | 230° C. |
| 4 | 4 | 1.47 | A | A | 1.44 | A | B | 140° C. | 250° C. |
| 5 | 5 | 1.53 | A | A | 1.52 | A | A | 140° C. | 220° C. |
| 6 | 6 | 1.53 | A | A | 1.51 | A | A | 150° C. | 215° C. |
| 7 | 7 | 1.43 | B | B | 1.39 | B | B | 125° C. | 245° C. |
| 8 | 8 | 1.42 | B | B | 1.38 | C | B | 135° C. | 240° C. |
| 9 | 9 | 1.45 | B | B | 1.41 | B | B | 135° C. | 240° C. |
| 10 | 10 | 1.38 | C | B | 1.35 | C | C | 140° C. | 240° C. |
| 11 | 11 | 1.39 | B | B | 1.34 | C | B | 145° C. | 235° C. |
| Comparative Example: | | | | | | | | | |
| 1 | 12 | 1.37 | C | B | 1.33 | C | B | 160° C. | 230° C. |
| 2 | 13 | 1.30 | C | C | 1.22 | C | D | 165° C. | 220° C. |
| 3 | 14 | 1.22 | C | C | 1.18 | D | D | 160° C. | 220° C. |
| 4 | 15 | 1.41 | C | B | 1.35 | C | C | 160° C. | 230° C. |
| 5 | 16 | 1.21 | C | D | 1.01 | D | D | 170° C. | 195° C. |

Production of Magnetic Toner 23

Magnetic Toner 23 was produced in the same manner as in Production of Magnetic Toner 1 except that the divinylbenzene used therein were used in an amount changed to 1.2 parts. Physical properties of Magnetic Toner 23 are shown in Table 4.

Production of Magnetic Toner 24

Magnetic Toner 24 was produced in the same manner as in Production of Magnetic Toner 1 except that the divinylbenzene used therein were used in an amount changed to 1.3 parts. Physical properties of Magnetic Toner 24 are shown in Table 4.

Production of Magnetic Toner 25

Magnetic Toner 25 was produced in the same manner as in Production of Magnetic Toner 1 except that the ester wax used therein were used in an amount changed to 0.5 part. Physical properties of Magnetic Toner 25 are shown in Table 4.

Production of Magnetic Toner 26

Magnetic Toner 26 was produced in the same manner as in Production of Magnetic Toner 1 except that the ester wax used therein were used in an amount changed to 25 parts. Physical properties of Magnetic Toner 26 are shown in Table 4.

Production of Magnetic Toner 27

Preparation of fine-resin-particle dispersion:

| | |
|---|---|
| Styrene | 303 parts |
| n-Butyl acrylate | 105 parts |
| Divinylbenzene | 2 parts |
| Dodecanethiol | 6 parts |
| Carbon tetrabromide | 4 parts |

The above components were mixed and dissolved to prepare a solution.

6 parts of a nonionic surface-active agent and 10 parts of an anionic surface-active agent were also dissolved in 550 parts of ion-exchange water, and the above solution was added thereto. These were dispersed and emulsified in a flask, followed by introducing 50 parts of ion-exchange water in which 5 parts of ammonium persulfate was dissolved, while being slowly stirred and mixed for 10 minutes. Next, the inside atmosphere of the system was sufficiently displaced with nitrogen, and thereafter the contents of the flask were heated to 70° C. using an oil bath with stirring, where emulsion polymerization was continued for 5 hours under the same conditions, obtaining anionic Fine-Resin-Particle Dispersion 1 containing fine resin particles of 160 nm in average particle diameter.

Preparation of magnetic-material dispersion:

| | |
|---|---|
| Magnetic Material 1 | 150 parts |
| Nonionic surface-active agent | 10 parts |
| Ion-exchange water | 400 parts |

The above components were mixed and dissolved, followed by dispersion for 10 minutes by means of a homogenizer to produce Magnetic-Material Dispersion 1.

Preparation of release agent dispersion:

| | |
|---|---|
| Paraffin wax (melting point peak temperature: 68° C.) | 50 parts |
| Cationic surface-active agent | 5.5 parts |
| Ion-exchange water | 200 parts |

The above components were subjected to dispersion by means of a pressure ejection type homogenizer to produce Release Agent Dispersion 1 containing release agent particles of 0.16 μm in center diameter.

Production of toner:

| | |
|---|---|
| Fine-Resin-Particle Dispersion 1 | 200 parts |
| Magnetic-Material Dispersion 1 | 283 parts |
| Release Agent Dispersion 1 | 64 parts |
| Polyaluminum chloride | 1.23 parts |

The above components were thoroughly mixed and dispersed by means of a homogenizer. Thereafter, in an oil bath for heating, the contents of a flask were heated to agglomeration temperature 58° C. with stirring. Then, these were retained at 58° C. for 60 minutes, followed by further addition of 30 parts of Fine-Resin-Particle Dispersion 1, which were gently stirred.

Next, the pH in the system was adjusted to 7.0 with an aqueous 0.5 mol/liter sodium hydroxide solution, and then the flask was closely sealed, and heated to 80° C. while continuing the stirring. Thereafter, the pH was lowered to 4.0, and retained for 6 hours. After the reaction was completed, the reaction mixture was cooled, filtered and sufficiently washed with ion-exchange water, and thereafter filtered, washed and dried to produce magnetic toner base particles. Then, 100 parts of the magnetic toner base particles thus obtained and 1.0 part of the same hydrophobic fine silica powder as used in Production of Magnetic Toner 1 were mixed by means of Henschel mixer (manufactured by Mitsui Miike Engineering Corporation) to produce Magnetic Toner 27 having a weight-average particle diameter of 5.8 μm. Physical properties of Magnetic Toner 27 are shown in Table 4.

TABLE 4

| | Toner Physical Properties 2 | | | | | |
|---|---|---|---|---|---|---|
| Magnetic toner | Weight = average particle diameter (μm) | Variation coefficient | Average circularity | Mode circularity | Softening point Ts (° C.) | THF-insoluble matter (wt. %) |
| 17 | 6.9 | 20 | 0.981 | 1.00 | 44.3 | 34 |
| 18 | 6.5 | 20 | 0.981 | 1.00 | 39.1 | 37 |
| 19 | 6.8 | 21 | 0.981 | 1.00 | 80.6 | 35 |
| 20 | 6.6 | 20 | 0.981 | 1.00 | 85.8 | 34 |
| 21 | 7.0 | 20 | 0.981 | 1.00 | 49.8 | 0.7 |
| 22 | 6.9 | 21 | 0.981 | 1.00 | 50.3 | 9 |
| 23 | 6.4 | 21 | 0.981 | 1.00 | 54.5 | 56 |
| 24 | 6.5 | 20 | 0.981 | 1.00 | 56.1 | 68 |
| 25 | 6.8 | 19 | 0.982 | 1.00 | 53.2 | 35 |

TABLE 4-continued

| Toner Physical Properties 2 | | | | | | |
|---|---|---|---|---|---|---|
| Magnetic toner | Weight = average particle diameter (μm) | Variation coefficient | Average circularity | Mode circularity | Softening point Ts (° C.) | THF-insoluble matter (wt. %) |
| 26 | 7.5 | 26 | 0.977 | 1.00 | 48.6 | 36 |
| 27 | 5.8 | 18 | 0.959 | 0.98 | 51.5 | 41 |

In addition, the magnetization intensity of each of the above magnetic toners under application of a magnetic field of 79.6 kA/m was within the range of from 29.0 to 31.0 $Am^2/kg$ in all the magnetic toners.

Examples 12 to 18

Using Magnetic Toners 17, 19, 22, 23 and 25 to 27, image reproduction tests and fixing tests were conducted in the same manner as in Example 1. As a result, all toners were able to form images beyond the level of no problem in practical use, and also showed good fixing performance. The evaluation results are shown in Table 3.

Comparative Example 6

Using Magnetic Toner 18, an image reproduction test and a fixing test were conducted in the same manner as in Example 1. As a result, although good fixing performance was attained, fog occurred seriously with occurrence of toner melt adhesion to the toner carrying member due to running, and images were practically undesirable. The evaluation results are shown in Table 5.

Comparative Example 7

Using Magnetic Toner 20, an image reproduction test and a fixing test were conducted in the same manner as in Example 1. As a result, although good images were obtained, the fixing start temperature was as high as 165° C., showing inferior low-temperature fixing performance. The evaluation results are shown in Table 5.

Comparative Example 8

Using Magnetic Toner 21, an image reproduction test and a fixing test were conducted in the same manner as in Example 1. As a result, although the fixing start temperature was as good as 130° C., the high-temperature anti-offset properties were so poor that no sufficient fixing range could be achieved. The evaluation results are shown in Table 5.

Comparative Example 9

Using Magnetic Toner 24, an image reproduction test and a fixing test were conducted in the same manner as in Example 1. As a result, although good images were obtained, the fixing start temperature was as high as 165° C., showing inferior low-temperature fixing performance. The evaluation results are shown in Table 5.

TABLE 5

| Test Results 2 | | | | | | | | | |
|---|---|---|---|---|---|---|---|---|---|
| | | Initial stage | | | After 2,000-sh. running | | | Fixing performance | |
| | Toner | Density | Fog | Image quality | Density | Fog | Image quality | Fixing start temp. | Fixing maximum temp. |
| Example: | | | | | | | | | |
| 12 | 17 | 1.49 | A | A | 1.44 | B | B | 125° C. | 240° C. |
| 13 | 19 | 1.53 | A | A | 1.53 | A | A | 150° C. | 245° C. |
| 14 | 22 | 1.51 | A | A | 1.47 | B | B | 130° C. | 205° C. |
| 15 | 23 | 1.52 | A | A | 1.52 | A | A | 150° C. | 260° C. |
| 16 | 25 | 1.51 | A | A | 1.50 | A | A | 145° C. | 240° C. |
| 17 | 26 | 1.47 | B | B | 1.43 | B | B | 125° C. | 240° C. |
| 18 | 27 | 1.42 | B | B | 1.36 | C | B | 150° C. | 215° C. |
| Comparative Example: | | | | | | | | | |
| 6 | 18 | 1.46 | A | B | 1.35 | C | D | 120° C. | 235° C. |
| 7 | 20 | 1.53 | A | A | 1.53 | A | A | 165° C. | 245° C. |
| 8 | 21 | 1.50 | A | A | 1.44 | B | B | 130° C. | 175° C. |
| 9 | 24 | 1.53 | A | A | 1.53 | A | A | 165° C. | 265° C. |

This application claims priority from Japanese Patent Application No. 2003-321147 filed Sep. 12, 2003, which is hereby incorporated by reference herein.

What is claimed is:

1. A magnetic toner comprising: at least a binder resin and a magnetic material and having a weight-average particle diameter of from 3 mm to 10 mm, wherein;

said magnetic material produced is by treating surfaces of magnetic fine particles with a coupling agent and, thereafter, with a low-softening substance (A) comprising a wax or a crystalline polyester having an endothermic peak from 80° C. to 150° C. measured by differential scanning calorimetry, and having a compressibility of 35 or more which is found from the following expression (1):

$$\text{compressibility}=(1-(\text{apparent density}/\text{tap density}))\times 100 \quad (1);$$

said magnetic material (a) is present in amounts of 10 to 200 parts by weight based on 100 parts by weight of the binder resin and (b) has been treated with said low -softening substance (A) in amounts from 0.3 to 15 parts by weight based on 100 parts by weight of the magnetic fine particles;

said magnetic toner has a softening point Ts of from 40° C. to 85° C. in measurement by a flow tester; and said magnetic toner has a resin component containing 1% by weight to 60% by weight of a tetrahydrofuran-insoluble matter.

2. The magnetic toner according to claim 1, wherein a ratio of a tap density of said magnetic material to a tap density of said magnetic fine particles (tap density of magnetic material/tap density of magnetic fine particles) is 0.80 to 1.00.

3. The magnetic toner according to claim 1, wherein a ratio of a tap density of said magnetic material to a tap density of said magnetic fine particles (tap density of magnetic material/tap density of magnetic fine particles) is 0.90 to 1.00.

4. The magnetic toner according to claim 1, wherein the softening point Ts is from 45° C. to 80° C. in measurement by a flow tester.

5. The magnetic toner according to claim 1, wherein the tetrahydrofuran-insoluble matter of said resin component is from 10% by weight to 55% by weight.

6. The magnetic toner according to claim 1, which has an average circularity of from 0.960 to 1.000.

7. The magnetic toner according to claim 1, which has a mode circularity of from 0.99 to 1.00.

8. The magnetic toner according to claim 1, wherein the compressibility of said magnetic material is 38 or more.

9. The magnetic toner according to claim 1, wherein a liberation percentage of said low-softening substance (A) from the magnetic material is 25% or less.

10. The magnetic toner according to claim 1, wherein a liberation percentage of said low-softening substance (A) from the magnetic material is 15% or less.

11. The magnetic toner according to claim 1, which further comprises a low-softening substance (B) in an amount of from 1 part by weight to 20 parts by weight based on 100 parts by weight of the binder resin, in addition to the low-softening substance (A) used in the surface treatment of the magnetic material.

12. The magnetic toner according to claim 11, wherein said low-softening substance (B) has an endothermic peak top in a range of 40° C. to 80° C. in measurement by differential scanning calorimetry.

13. The magnetic toner according to claim 1, which has a variation coefficient of 40 or less in number distribution.

14. The magnetic toner according to claim 1, which has a variation coefficient of 30 or less in number distribution.

* * * * *